US011976415B2

(12) United States Patent
Motohashi et al.

(10) Patent No.: US 11,976,415 B2
(45) Date of Patent: May 7, 2024

(54) FIBER TRANSPORT APPARATUS

(71) Applicant: SEIKO EPSON CORPORATION, Tokyo (JP)

(72) Inventors: Koji Motohashi, Nagano (JP); Makoto Sato, Nagano (JP); Takashi Abe, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 412 days.

(21) Appl. No.: 16/902,314

(22) Filed: Jun. 16, 2020

(65) Prior Publication Data

US 2020/0399825 A1 Dec. 24, 2020

(30) Foreign Application Priority Data

Jun. 18, 2019 (JP) ..... 2019-112945
Jun. 18, 2019 (JP) ..... 2019-112946

(51) Int. Cl.
*D21B 1/06* (2006.01)

(52) U.S. Cl.
CPC ..... *D21B 1/063* (2013.01)

(58) Field of Classification Search
CPC ..... D21B 1/063
USPC ..... 162/262
See application file for complete search history.

(56) References Cited

U.S. PATENT DOCUMENTS

| | | | |
|---|---|---|---|
| 5,709,296 | A | 1/1998 | Forsberg |
| 2005/0158541 | A1 | 7/2005 | Tanaka |
| 2014/0356521 | A1 | 12/2014 | Oku et al. |
| 2019/0032280 | A1 | 1/2019 | Miyasaka |
| 2020/0270814 | A1 | 8/2020 | Miyasaka |

FOREIGN PATENT DOCUMENTS

| | | | |
|---|---|---|---|
| CN | 103958075 | A | 7/2014 |
| CN | 108609404 | A | 10/2018 |
| JP | S59-140205 | U | 9/1984 |
| JP | H02-264019 | A | 10/1990 |
| JP | 08-217241 | A | 8/1996 |
| JP | H09-512775 | A | 12/1997 |
| JP | 2005-131790 | A | 5/2005 |
| JP | 2009-255000 | A | 11/2009 |
| JP | 2010-070194 | A | 4/2010 |
| JP | 2011-241497 | A | 12/2011 |
| JP | 2019-026968 | A | 2/2019 |

*Primary Examiner* — Jacob T Minskey
(74) *Attorney, Agent, or Firm* — Global IP Counselors, LLP

(57) ABSTRACT

A storage portion includes a case which includes an internal space configured to accommodate raw material pieces having fibers, a discharge pipe coupled to a side wall of the case, and a transport motor which rotates the discharge pipe on an axis, in which one end in an axial direction of the discharge pipe communicates with the internal space and the other end has an outlet for discharging the raw material pieces, and a spiral member is provided on an inner peripheral surface of the discharge pipe.

15 Claims, 20 Drawing Sheets

FIBER TRANSPORT APPARATUS

The present application is based on, and claims priority from JP Application Serial Number 2019-112945, filed Jun. 18, 2019 and JP Application Serial Number 2019-112946, filed Jun. 18, 2019, the disclosures of which are hereby incorporated by reference herein in their entirety.

BACKGROUND

1. Technical Field

The present disclosure relates to a fiber transport apparatus.

2. Related Art

In the related art, a transport apparatus which transports fiber pieces stirred inside a container from the container is known. For example, JP-A-2011-241497 describes a configuration in which a rectangular frame-shaped casing is communicated and attached to an outlet at a lower end of a storage container in which fiber pieces made of paper is stirred, a scraping rod of a rotation shaft disposed inside the casing scraps the fiber pieces in the casing from the outlet, and the fiber pieces dropped from the outlet are discharged by a pair of rotatable delivery rollers arranged to face each other inside the casing.

Meanwhile, since there are bent pieces and the like among the fiber pieces, in the configuration described in JP-A-2011-241497, a state of the fiber piece caught between rollers in the delivery rollers tends to vary, and the transport amount of fiber pieces may vary.

SUMMARY

According to an aspect of the present disclosure, there is provided a fiber transport apparatus including: a case that has an internal space configured to accommodate fiber pieces containing fibers; a tube coupled to a side surface of the case; and a driving portion that rotates the tube on an axis, in which one end of the tube in an axial direction communicates with the internal space, and another end has an outlet for discharging the fiber pieces, and a protrusion is provided on an inner surface of the tube.

In the fiber transport apparatus, the protrusion may be in a spiral shape and provided on the tube with respect to the axis.

In the fiber transport apparatus, an inner surface on an outlet side of the tube may be a low friction portion having a friction coefficient lower than a friction coefficient of the inner surface of the tube on a coupling portion side with the case.

In the fiber transport apparatus, a rib may be formed at a peripheral portion of the outlet in the tube.

In the fiber transport apparatus, the protrusion may have a first protrusion in a spiral shape and a second protrusion in a spiral shape, and the first protrusion and the second protrusion may be provided in a part, including the outlet, of the tube.

In the fiber transport apparatus, the second protrusion may have a pitch identical with a pitch of the first protrusion, and the second protrusion may be displaced from the first protrusion by a half cycle in a rotation direction of the tube.

In the fiber transport apparatus, the tube may be inclined such that the outlet is lower in a vertically downward direction than a coupling portion with the case.

In the fiber transport apparatus, a container that accommodates the fiber pieces may be disposed below the outlet.

In the fiber transport apparatus, a weight measurement portion that measures a weight of the fiber pieces accommodated in the container may be disposed.

In the fiber transport apparatus, a rotator that rotates on a virtual rotation axis extending in a height direction of the case and stirs the fiber pieces may be provided inside the case, and the tube may be coupled to the case at an overlapping position with the rotator in the height direction of the case.

The fiber transport apparatus may further include a control portion that controls the driving portion, in which the driving portion rotates a rotator that rotates on an axis along a transport path, and the control portion is configured to switch a rotation direction of the rotator between a forward direction and a reverse direction.

In the fiber transport apparatus, the rotator may be the tube that forms the transport path, and the driving portion may rotate the tube.

In the fiber transport apparatus, the protrusion may be in a spiral shape and disposed on the tube with respect to the axis.

In the fiber transport apparatus, the tube may be inclined such that the outlet is lower than a coupling portion with the case.

In the fiber transport apparatus, a container that accommodates the fiber pieces may be disposed below the outlet.

In the fiber transport apparatus, a weight measurement portion that measures a weight of the fiber pieces accommodated in the container may be disposed.

In the fiber transport apparatus, a second rotator that rotates on a virtual rotation axis extending in a height direction of the case and stirs the fiber pieces may be provided inside the case, and the tube may be coupled to the case at an overlapping position with the second rotator in the height direction of the case.

DESCRIPTION OF EXEMPLARY EMBODIMENTS

Hereinafter, appropriate embodiments of the present disclosure will be described in detail with reference to the accompanying drawings. The embodiments to be described below do not limit contents of the disclosure described in the claims. In addition, all of configurations to be described below are not essential components of the disclosure.

1. Embodiment 1

1-1. Overall Configuration of Sheet Manufacturing Apparatus

Figure 1:
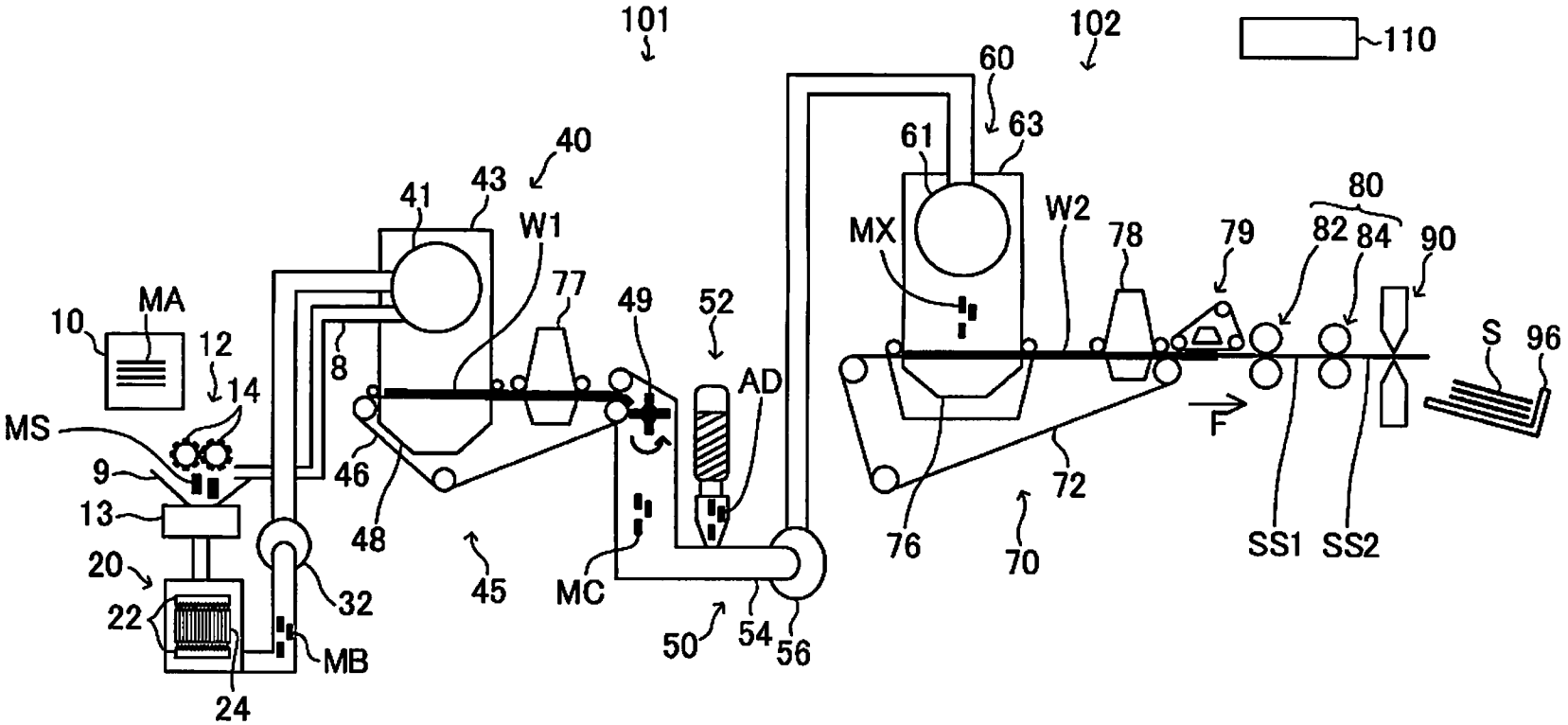
FIG. 1 is a diagram illustrating a configuration of a sheet manufacturing apparatus.

FIG. 1 is a diagram illustrating a configuration of a sheet manufacturing apparatus 100.

The sheet manufacturing apparatus 100 manufactures a sheet S by fiberizing a raw material MA containing fibers such as a wood-based pulp material or kraft pulp, waste paper, and synthetic pulp.

The sheet manufacturing apparatus 100 includes a supply portion 10, a crushing portion 12, a storage portion 13, a defibration portion 20, a sorting portion 40, a first web forming portion 45, a rotator 49, a mixing portion 50, a dispersion portion 60, a second web forming portion 70, a web transport portion 79, a processing portion 80, and a cutting portion 90.

The supply portion 10 supplies the raw material MA to the crushing portion 12. The crushing portion 12 is a shredder which cuts the raw material MA by a crushing blade 14. The raw material MA is cut into paper pieces by the crushing portion 12 to become raw material pieces MS, and the raw material pieces MS are collected by a hopper 9 and transported into the storage portion 13. The raw material piece MS can be referred to as a crushed piece or a cut piece, and corresponds to an example of a fiber piece containing fibers. The raw material piece MS has, for example, a rectangular shape with a length of approximately 20 mm and a width of approximately 3 mm.

The storage portion 13 temporarily stores the raw material pieces MS supplied from the crushing portion 12 and supplies a predetermined amount of raw material pieces MS to the defibration portion 20. As a result, it is possible to stabilize the supply amount of raw material pieces MS supplied for a manufacturing process of the sheet S and to hold a predetermined amount of raw material pieces MS.

The defibration portion 20 defibrates the fine piece cut by the crushing portion 12 in a dry method to obtain a defibrated material MB. The defibration is a process of unraveling the raw material piece MS in a state in which a plurality of fibers are bound into one or a small number of fibers. The dry method refers to performing a process such as defibration in the air, instead of in a liquid. For example, the defibrated material MB contains components derived from the raw material MA, such as fibers contained in the raw material MA, resin particles, coloring agents such as ink or toner, anti-smearing materials, and paper strength enhancers.

The defibration portion 20 is, for example, a mill which includes a tube-shaped stator 22 and a rotor 24 which rotates inside the stator 22, and defibrates the raw material piece MS by sandwiching the raw material piece MS between the stator 22 and the rotor 24. The defibrated material MB is sent to the sorting portion 40 through a pipe.

The sorting portion 40 includes a drum portion 41 and a housing portion 43 which accommodates the drum portion 41. The drum portion 41 is a sieve having openings such as a net, a filter, and a screen, and is rotated by power of a motor (not illustrated). The defibrated material MB unravels inside the rotating drum portion 41 and descends through the opening of the drum portion 41. Among components of the defibrated material MB, a component does not pass through the opening of the drum portion 41 is transported to the hopper 9 through a pipe 8.

The first web forming portion 45 includes an endless-shaped mesh belt 46 having a large number of openings. The first web forming portion 45 manufactures a first web W1 by accumulating fibers and the like descending from the drum portion 41 on the mesh belt 46. Among the components descending from the drum portion 41, those smaller than the opening of the mesh belt 46 pass through the mesh belt 46 and are suctioned and removed by a suction portion 48. Thus, among the components of the defibrated material MB, short fibers, resin particles, ink, toner, anti-smearing agents, and the like, which are not appropriate for manufacturing the sheet S, are removed.

A humidifier 77 is disposed on a movement path of the mesh belt 46, and the first web W1 accumulated on the mesh belt 46 is humidified by mist-like water or high-humidity air.

The first web W1 is transported by the mesh belt 46 and comes into contact with the rotator 49. The rotator 49 divides the first web W1 by a plurality of blades to obtain a material MC. The material MC is transported to the mixing portion 50 through a pipe 54.

The mixing portion 50 includes an additive supply portion 52 which adds an additive material AD to the material MC, and a mixing blower 56 which mixes the material MC and the additive material AD. The additive material AD includes a binding material such as a resin for binding a plurality of fibers, and may include a colorant, an aggregation inhibitor, a flame retardant, and the like. The mixing blower 56 generates airflow in the pipe 54 to which the material MC and the additive material AD are transported, mixes the material MC and the additive material AD, and transports a mixture MX to the dispersion portion 60.

The dispersion portion 60 includes a drum portion 61 and a housing 63 which accommodates the drum portion 61. The drum portion 61 is a cylinder-shaped sieve having the same configuration as the drum portion 41, and is driven by a motor (not illustrated) to rotate. By the rotation of the drum portion 61, the mixture MX unravels and descends into the housing 63.

The second web forming portion 70 includes an endless-shaped mesh belt 72 having a large number of openings. The second web forming portion 70 manufactures a second web W2 by accumulating the mixture MX descending from the drum portion 61 on the mesh belt 72. Among components of the mixture MX, those smaller than the opening of the mesh belt 72 pass through the mesh belt 72 and are suctioned by a suction portion 76.

A humidifier 78 is disposed on a movement path of the mesh belt 72, and the second web W2 accumulated on the mesh belt 72 is humidified by mist-like water or high-humidity air.

The second web W2 is peeled off from the mesh belt 72 by the web transport portion 79, and is transported to the processing portion 80. The processing portion 80 includes a pressing portion 82 and a heating portion 84. The pressing portion 82 sandwiches the second web W2 between a pair of pressing rollers and presses the second web W2 with a predetermined nip pressure to form a pressurized sheet SS1. The heating portion 84 applies heat across the pressurized sheet SS1 by a pair of heating rollers. Thus, fibers contained in the pressurized sheet SS1 are bound by resin contained in the additive material AD, and a heated sheet SS2 is formed. The heated sheet SS2 is transported to the cutting portion 90.

The cutting portion 90 cuts the heated sheet SS2 in a direction crossing a transport direction F and/or in a direction along the transport direction F, and manufactures a sheet S having a predetermined size. The sheet S is stored in a discharge portion 96.

The sheet manufacturing apparatus 100 includes a control apparatus 110. The control apparatus 110 controls each portion of the sheet manufacturing apparatus 100 including the defibration portion 20, the additive supply portion 52, the mixing blower 56, the dispersion portion 60, the second web forming portion 70, the processing portion 80, and the cutting portion 90 so as to execute a method of manufacturing the sheet S. Further, the control apparatus 110 may control the operations of the supply portion 10, the sorting portion 40, the first web forming portion 45, and the rotator 49.

1-2. Configuration of Storage Portion

Figure 2:
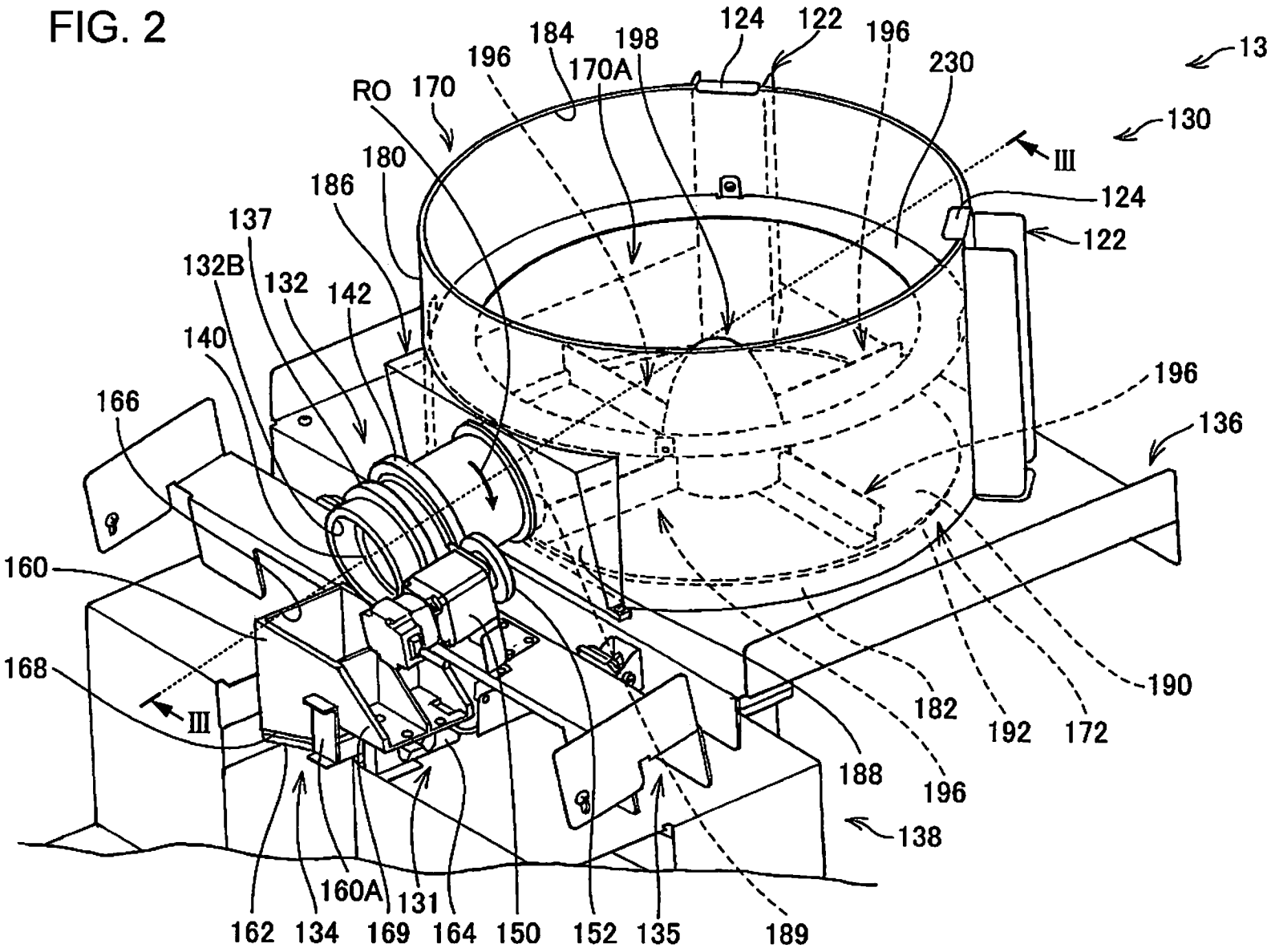
FIG. 2 is a perspective view of a storage portion.
Figure 3:
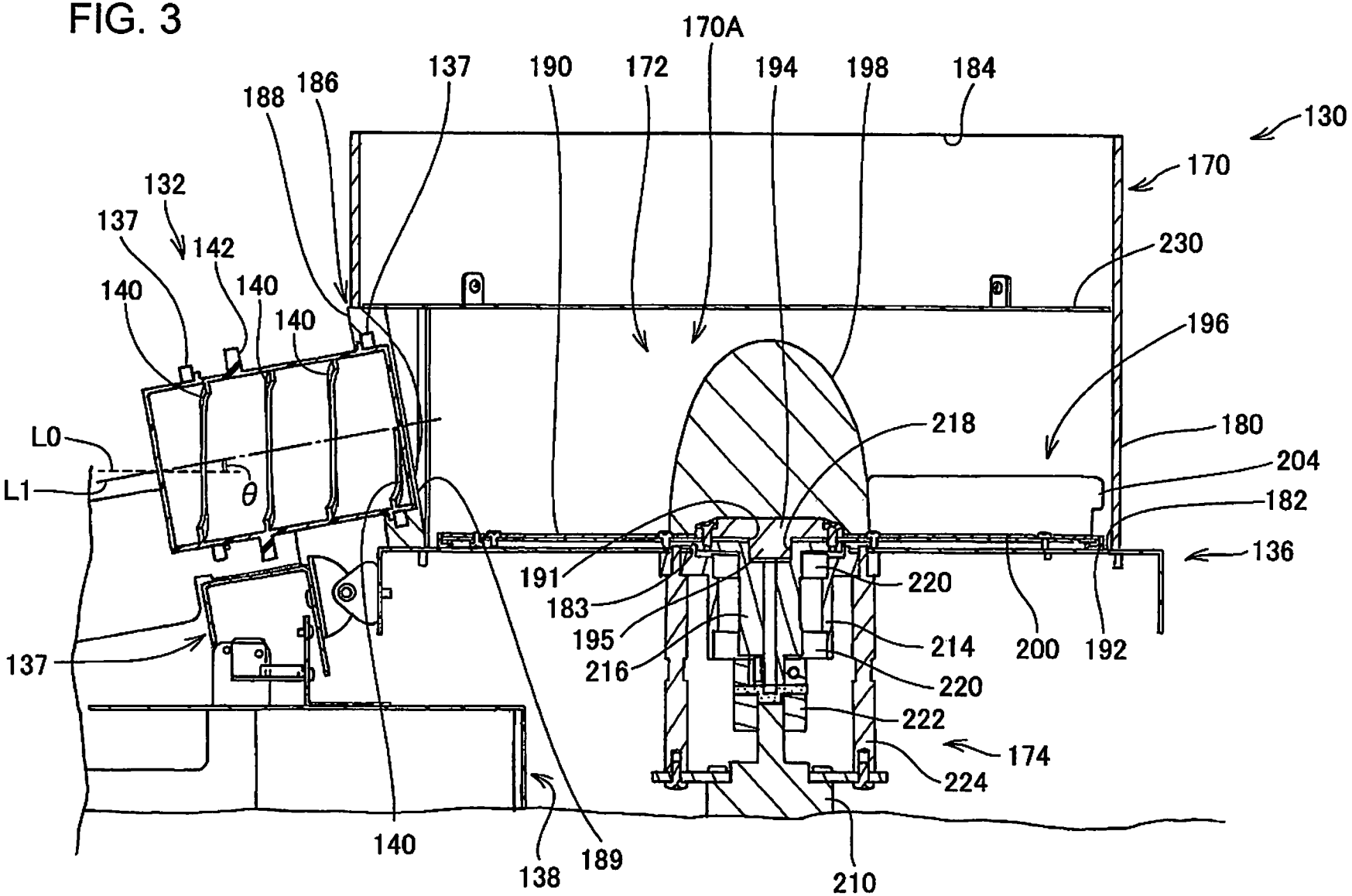
FIG. 3 is a longitudinal cross-sectional view taken along the line III-III in FIG. 2.

FIG. 2 is a perspective view of the storage portion 13. FIG. 3 is a longitudinal cross-sectional view taken along the line in FIG. 2. In FIG. 3, a measurement portion 134 is not illustrated.

The storage portion 13 includes a stirring apparatus 130, a discharge pipe 132, and the measurement portion 134.

The stirring apparatus 130 has a function of temporarily storing the raw material pieces MS transported from the hopper 9 and a function of stirring the stored raw material pieces MS. The stirring apparatus 130 includes a case 170, a rotator 172, and a drive mechanism 174, as illustrated in FIG. 3.

The hopper 9 is located above an opening portion 184 of the case 170, and the raw material pieces MS are put into the case 170 from the hopper 9 through the opening portion 184.

The case 170 is formed such that a side wall 180, which is a cylinder-shaped member, is mounted on a mounting table 136, and accommodates the raw material pieces MS. A bottom portion of the side wall 180 is open and clogged by an upper surface of the mounting table 136. That is, the upper surface of the mounting table 136 forms a bottom surface 182 of the case 170.

The side wall 180 is fixed to the mounting table 136 by a plurality of support members 122. The support member 122 is a columnar member having a C-shaped cross-section, and is erected on the upper surface of the mounting table 136. A claw portion 124 is provided at an upper end of the support member 122, and the claw portion 124 is engaged with an upper end of the side wall 180, so that the side wall 180 is fixed to the mounting table 136. In the present embodiment, a configuration in which four support members 122 are arranged at equal intervals along the outer periphery of the case 170 is illustrated. FIG. 2 illustrates only some of the support members 122. The side wall 180 may be fixed to the mounting table 136 by an adhesive or the like without using the support member 122. Further, the support member 122 and the side wall 180 may be fixed by an adhesive.

An annular overhang 230 is provided on the inner peripheral surface of the side wall 180. The overhang 230 regulates winding of the raw material pieces MS so that the raw material pieces MS stirred inside the stirring apparatus 130 do not overflow from the opening portion 184. A width and a height position of the overhang 230 can be appropriately changed in accordance with a shape or a size and a processing speed of the stirring apparatus 130.

A discharge portion 186 is provided on the side wall 180. The discharge portion 186 corresponds to an example of a coupling portion. The discharge portion 186 is a hollow overhang portion provided from a lower portion of the side wall 180 toward the outside of the case 170. The measurement portion 134 is disposed outside the case 170 so as to face the discharge portion 186.

The discharge portion 186 includes an inclined surface 188 which is inclined downward to face the measurement portion 134. An outlet 189 is open on the inclined surface 188, and the raw material pieces MS can be discharged from the inside of the case 170 through the outlet 189. The discharge pipe 132 is coupled to the outlet 189.

The rotator 172 which stirs the raw material pieces MS is disposed at a bottom portion of the case 170. The rotator 172 corresponds to an example of a stirring portion. The rotator 172 is rotatably installed with respect to the bottom surface 182, and includes a rotating portion 190, a plurality of blades 196, and a protrusion member 198.

The rotating portion 190 is a disk-shaped member which is disposed so as to overlap with the bottom surface 182, and a boundary between the rotating portion 190 and the bottom surface 182 is sealed by a sealing member 192. The sealing member 192 suppresses a situation in which the raw material pieces MS enter between the rotating portion 190 and the bottom surface 182, are compressed, and becomes a lump. The sealing member 192 is formed of, for example, a resin such as polyacetal.

A center hole 191, which is a through-hole, is provided at a rotation center of the rotating portion 190. Further, a bottom surface hole 183, which is a through-hole, is provided at a position at which the bottom surface 182 overlaps with a center of the rotating portion 190, on the bottom surface 182. A coupling member 194 which penetrates through the center hole 191 and reaches an inside of the bottom surface hole 183 is disposed in the rotating portion 190. The coupling member 194 is fixed to the rotating portion 190.

The rotator 172 is coupled to the drive mechanism 174, and is rotated by power of the drive mechanism 174.

The drive mechanism 174 includes a stirring motor 210, a housing member 214, a drive shaft 216, and the coupling member 194, and is disposed below the mounting table 136. The housing member 214 is a cylinder-shaped housing which accommodates the drive shaft 216, and is coupled to a lower surface of the mounting table 136.

The drive shaft 216 is an output shaft of the stirring motor 210, passes through an inside of the housing member 214, and is coupled to an insertion portion 195 formed below the coupling member 194 inside the bottom surface hole 183. The drive shaft 216 is rotatably supported by the housing member 214 by two bearings 220.

With this configuration, when the stirring motor 210 operates and the drive shaft 216 rotates, the rotator 172 rotates at the bottom portion of the case 170 together with the drive shaft 216.

The plurality of blades 196 are fixed to an upper surface of the rotating portion 190. The blade 196 is disposed so as to extend radially from the rotation center of the rotating portion 190. In the present embodiment, the four blades 196 are arranged in the rotator 172, and the respective blades 196 are arranged at predetermined intervals in a circumferential direction of the rotating portion 190. A flange 200 is formed at a lower end of the blade 196, and the flange 200 is fixed in surface contact with the rotating portion 190. With this configuration, there is an effect of preventing the raw material pieces MS from entering between the blade 196 and the rotating portion 190. Although an example in which the blade 196 is erected substantially vertically is illustrated, the blade 196 may be installed at an angle which is an acute angle or an obtuse angle from the upper surface of the rotating portion 190. The blade 196 rotates together with the rotating portion 190 to stir the raw material pieces MS. The blade 196 corresponds to an example of a second rotator.

One end of the blade 196 is close to the coupling member 194 near a center of the rotator 172. The other end of the blade 196 is located at a position close to the periphery of the rotating portion 190. For this reason, when the rotator 172 rotates, the raw material pieces MS are stirred over a wider range in a radial direction of the case 170.

A protrusion piece 204 which protrudes in a radial direction of the rotating portion 190 is formed at an end of the blade 196 at an outer peripheral portion of the rotator 172. The protrusion piece 204 is disposed at an overlapping position with the outlet 189 in a height direction of the case 170. The protrusion piece 204 acts to push the raw material piece MS to the outlet 189 while the rotator 172 rotates.

The protrusion member 198 is disposed at a rotation center of the upper surface of the rotating portion 190. The protrusion member 198 is a semi-elliptical sphere or a hemispherical member, and covers the coupling member 194. In addition, an end of the blade 196 and the coupling member 194 are coupled such that there is no gap or the gap is small. A height of the protrusion member 198 may be higher than a height of the blade 196, and in the present embodiment, is approximately half a height of the side wall 180.

The protrusion member 198 closes a space at the rotation center of the rotating portion 190, and suppresses the accumulation of the raw material pieces MS in this space. The raw material piece MS located at the rotation center of the rotating portion 190 is not easily affected by centrifugal force due to the rotation, and does not contact the blade 196. For this reason, when the rotating portion 190 is rotated, the raw material piece MS tends to stay at the rotation center. By disposing the protrusion member 198 at the rotation center of the rotating portion 190 to close the space of the rotation center, stagnation of the raw material pieces MS can be suppressed, and the raw material pieces MS can be effectively stirred in the case 170. A shape of the protrusion member 198 is not limited to the hemisphere or the semi-elliptic sphere, and may be a cone such as a cone or a pyramid, or a cone having a spherical tip.

Figure 4:
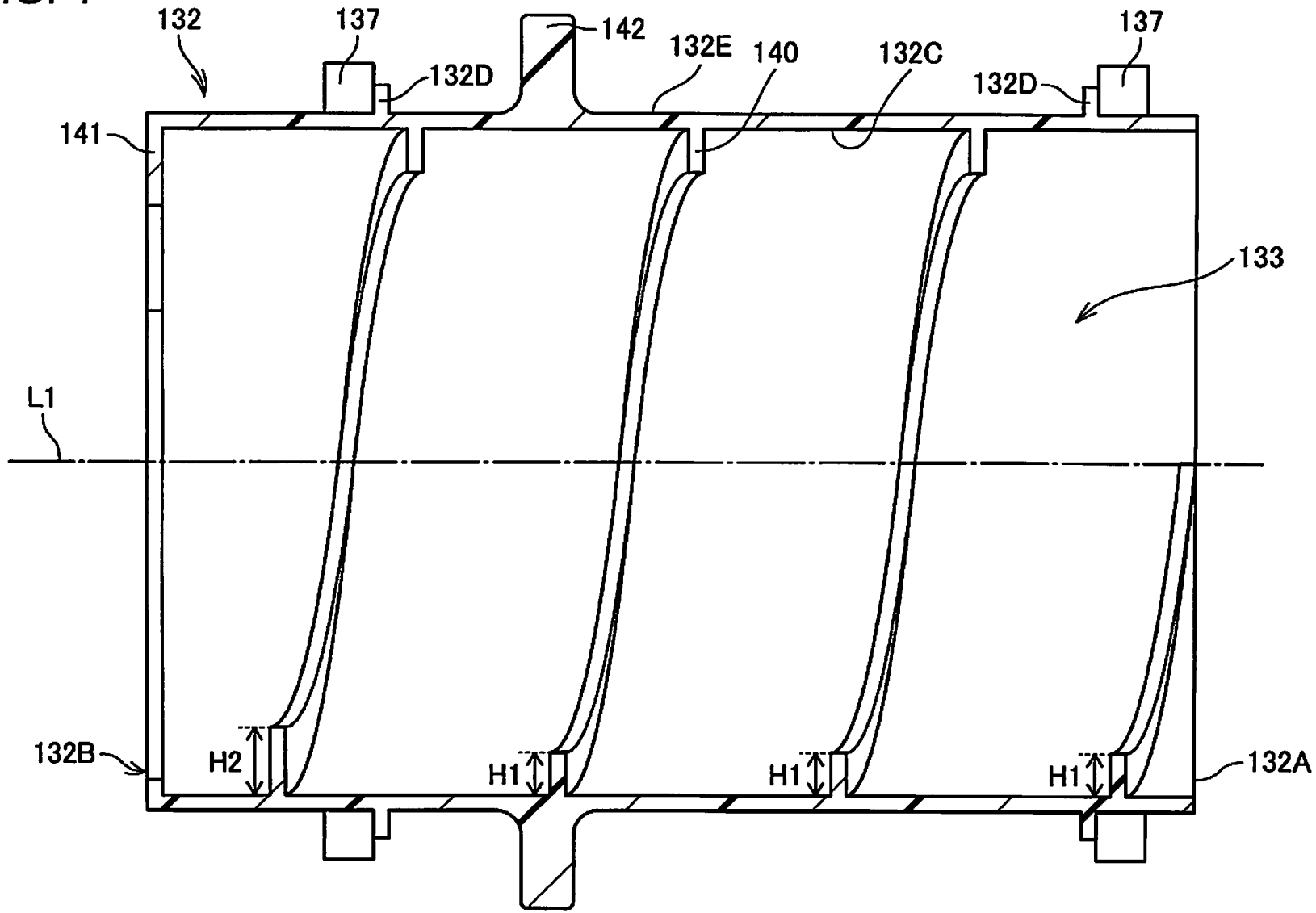
FIG. 4 is a cross-sectional view of a discharge pipe.

FIG. 4 is a cross-sectional view of the discharge pipe 132.

The discharge pipe 132 is a hollow tubular member, and transports the raw material pieces MS stored in the stirring apparatus 130 toward the measurement portion 134. In the present embodiment, the discharge pipe 132 is a straight pipe having a circular cross-section, and a virtual axis passing through a center of the cross section is defined as a central axis L1. The discharge pipe 132 corresponds to an example of a rotator. Further, the discharge pipe 132 corresponds to an example of a tube. The central axis L1 corresponds to an example of an axis. In addition, a direction along the central axis L1 is also referred to as an axial direction. The discharge pipe 132 according to the present embodiment is made of ABS resin, but may be made of another material. Here, the ABS is an abbreviation of acrylonitrile butadiene styrene.

Both ends of the discharge pipe 132 are open, an opening at one end is an inlet 132A, and an opening at the other end is an outlet 132B. The inlet 132A is coupled to the discharge portion 186 of the stirring apparatus 130, communicates with an internal space 170A of the case 170, and the outlet 132B opens at a position close to the measurement portion 134. The discharge pipe 132 functions as a transport path 133 which transports the raw material pieces MS from the internal space 170A to the measurement portion 134.

The discharge pipe 132 is installed horizontally so that the outlet 132B is at the same height position as the inlet 132A, or is inclined so that the outlet 132B is at a lower position than the inlet 132A. The inclination of the discharge pipe 132 is specified by an angle θ of the central axis L1 from a horizontal line L0, and for example, the angle θ is appropriately within a range equal to or more than 0° and equal to or less than 15°, and appropriately 5° in particular.

An annular rib 141 is formed at an edge of the outlet 132B. According to the formation of the rib 141, a diameter of the outlet 132B is reduced. The rib 141 suppresses discharge of the raw material pieces MS from the outlet 132B, and facilitates adjustment of the amount of raw material pieces MS discharged from the outlet 132B.

Spiral members 140 are arranged inside the discharge pipe 132.

Figure 5:
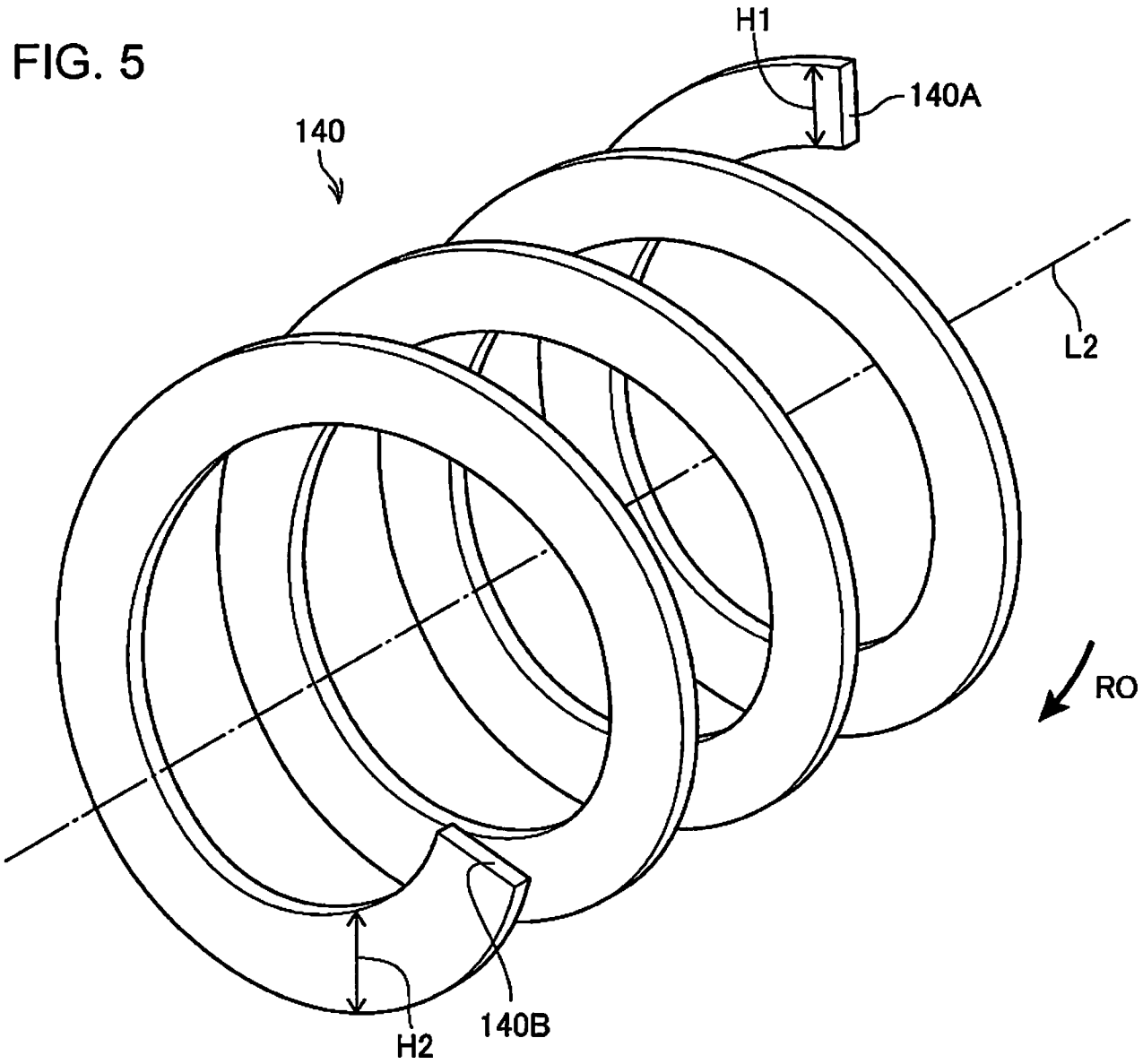
FIG. 5 is a perspective view of a spiral member.

FIG. 5 is a perspective view of the spiral member 140.

The spiral member 140 has a shape in which a thin plate having a rectangular cross-section draws a spiral. The spiral member 140 illustrated in FIG. 5 forms the spiral having three and a half turns at an equal pitch, but the number of turns and the pitch of the spiral member 140 can be optionally changed. Here, the pitch refers to a length of the spiral member 140 per one turn in a direction along an axis L2. The axis L2 is a virtual axis passing through a center of a circumference of the spiral member 140, and ends of the spiral member 140 in the direction along the axis L2 are referred to as an end 140A and an end 140B. A width of the spiral member 140 may be uniform throughout, but in the present embodiment, a width H2 of the spiral member 140 in one turn including the end 140B is larger than a width H1 of the spiral member 140 in the other turn, and the amount of raw material pieces MS discharged from the outlet 132B can be easily adjusted.

The spiral member 140 is disposed along an inner peripheral surface 132C of the discharge pipe 132. The spiral member 140 may be in close contact with the inner peripheral surface 132C without any gap. The axis L2 of the spiral member 140 coincides with the central axis L1 of the discharge pipe 132, or may be parallel to the central axis L1. The end 140A of the spiral member 140 is located near the inlet 132A of the discharge pipe 132, and the end 140B is located near the outlet 132B. The end 140A and the inlet 132A may be separated, and the end 140B and the outlet 132B may be separated. The inner peripheral surface 132C corresponds to an example of an inner surface of the discharge pipe 132 which is a tube.

By disposing the spiral member 140 inside the discharge pipe 132, a protrusion in a spiral shape is formed at the inner peripheral surface 132C. A height of the protrusion formed by the spiral member 140 is the width H1 and the width H2 of the spiral member 140. For this reason, in an internal space of the discharge pipe 132, a height H2 of the protrusion at a position near the outlet 132B is higher than a height H1 of the protrusion at a position near the inlet 132A.

The discharge pipe 132 is rotatably supported by bearings 137 and 137. Annular bearing support portions 132D and 132D are attached to an outer peripheral surface 132E of the discharge pipe 132, and the bearing support portions 132D are 132D respectively fit into the bearings 137 and 137. One bearing 137 is fixed to the discharge portion 186, and the other bearing 137 is fixed to a pipe support member 135 provided on a side surface of the mounting table 136. Thus, the discharge pipe 132 is supported at a plurality of positions in a longitudinal direction.

A driven gear 142 is provided on the outer peripheral surface 132E of the discharge pipe 132 between the bearing support portions 132D and 132D. The driven gear 142 is a spur gear disposed or formed at the outer peripheral surface 132E in a circumferential direction. The driven gear 142 is coupled to a transport motor 150 installed on an upper surface of the pipe support member 135. Here, the transport motor 150 corresponds to an example of a driving portion. A drive gear 152 is attached to a drive shaft of the transport motor 150, and the drive gear 152 meshes with the driven gear 142. When the transport motor 150 rotates the drive shaft, the discharge pipe 132 rotates on the central axis L1. The transport motor 150 of the present embodiment rotates the discharge pipe 132 so that the spiral member 140 rotates in a forward direction RO.

A transport apparatus 131 which transports the raw material pieces MS is configured to include the discharge pipe 132, the spiral member 140, the driven gear 142, the transport motor 150, the drive gear 152, and the like.

The discharge pipe 132 rotates at a speed corresponding to a rotation speed of the transport motor 150. The rotation speed of the discharge pipe 132 affects the transport amount of raw material pieces MS transported by the discharge pipe 132. The control apparatus 110 controls rotation of the transport motor 150 such that the rotation speed of the discharge pipe 132 is within an appropriate range.

When the rotation speed of the discharge pipe 132 is too low, that is, when the number of revolutions per unit time is small, an action of lifting the raw material pieces MS inside the discharge pipe is weak and an effect of dropping and unraveling by gravity is small, so that it is difficult to break the lump-shaped raw material pieces MS. Further, since the rotation speed of the discharge pipe 132 is low, the raw material pieces MS are less likely to move in a direction of the central axis L1, and the amount of raw material pieces MS transported by the discharge pipe 132 is reduced. On the other hand, when the rotation speed of the discharge pipe 132 is too high, that is, when the number of revolutions per unit time is large, the raw material pieces MS inside the discharge pipe are in a state of being attached to the inner peripheral surface 132C by centrifugal force, and is not dropped by gravity from the state of being lifted inside the discharge pipe 132, so that it is difficult to transport the raw material pieces MS. Therefore, the raw material pieces MS are less likely to move in the direction of the central axis L1, and the amount of raw material pieces MS transported by the discharge pipe 132 is small.

Therefore, by adjusting the rotation speed of the discharge pipe 132 within the appropriate range, the raw material pieces MS can be stably transported while unraveling, inside the discharge pipe 132.

The rotation speed of the discharge pipe 132 is adjusted, for example, within a range equal to or more than 45 rpm (revolutions/min) and equal to or less than 105 rpm. In particular, a speed within a range equal to or more than 50 rpm and equal to or less than 95 rpm is appropriate, and the raw material pieces MS can be transported effectively. In the present embodiment, as an example, the discharge pipe 132 is rotated at 75 rpm.

As illustrated in FIG. 2, the measurement portion 134 is disposed below the outlet 132B of the discharge pipe 132. The measurement portion 134 includes a reception portion 160 which stores the raw material pieces MS discharged from the outlet 132B, and a load cell 164 which measures a weight of the reception portion 160. The reception portion 160 corresponds to an example of a container which accommodates the raw material pieces MS. The load cell 164 is fixed to a support 138. The load cell 164 measures a weight of the raw material pieces MS stored in the reception portion 160 by measuring the weight of the reception portion 160, and corresponds to an example of a weight measurement portion.

The reception portion 160 is a hollow box-shaped member having an open upper surface. Since the outlet 132B is located above an upper opening portion 166 of the reception portion 160, the raw material pieces MS fall from the outlet 132B and are stored in the reception portion 160.

A side surface of the reception portion 160 is provided with a protrusion portion 169 which protrudes sideways, and a bottom portion of the protrusion portion 169 is in contact with the load cell 164. For this reason, a load is applied to the load cell 164 from the reception portion 160 via the protrusion portion 169.

A bottom opening portion 168 is open on a bottom surface of the reception portion 160, and a closing member 162 is attached to the bottom opening portion 168.

The closing member 162 is rotatably attached by a shaft 160A. The closing member 162 is rotatable between a closing position for closing the bottom opening portion 168 and an opening position for opening the bottom opening portion 168 by power of an opening and closing motor (not illustrated). That is, the bottom opening portion 168 of the reception portion 160 is opened and closed by an operation of the opening portion and closing motor. When the bottom opening portion 168 is opened, the raw material pieces MS stored in the reception portion 160 are discharged and sent to the defibration portion 20. The bottom opening portion 168 may be opened and closed by a sliding plate member. The opening and closing motor corresponds to an example of a driving portion for opening and closing.

The load cell 164 is a sensor which measures a weight or a force such as torque, measures a force applied via the protrusion portion 169, and outputs a signal indicating the measured value. The signal output from the load cell 164 is input to the control apparatus 110 to be described below, and the opening and closing motor (not illustrated) is driven by control of the control apparatus 110.

1-3. Operation of Storage Portion

When the sheet manufacturing apparatus 100 is started, in the stirring apparatus 130 of the storage portion 13, the stirring motor 210 is driven to rotate the rotator 172. Further, in the transport apparatus 131 of the storage portion 13, the transport motor 150 is driven to rotate the discharge pipe 132.

When the raw material pieces MS are put into the case 170 of the stirring apparatus 130 from the hopper 9, the raw material pieces MS are stirred by the rotator 172 which rotates at the bottom portion inside the case 170. The raw material pieces MS are stirred by the blades 196 of the rotator 172 while being sent outward in a radial direction of the rotator 172, that is, in a direction of the side wall 180 of the case 170. Thus, even when a plurality of types of raw material pieces MS having different densities, thicknesses, colors, and the like are put into, a mixing state of the raw material pieces MS can be easily homogenized inside the case 170. In the rotator 172, the rotating portion 190 and the blade 196, which form a part of the bottom surface 182, rotate integrally. For this reason, for example, unlike the case where only the blade rotates on the bottom surface portion, it is possible to suppress the raw material piece MS from being compressed between the blade 196 and the bottom surface 182 and becoming a lump.

The stirred raw material pieces MS are sent from the discharge portion 186 of the case 170 to the discharge pipe 132 of the transport apparatus 131 by the blade 196. In the discharge pipe 132, the raw material pieces MS sent into the discharge pipe 132 are transported to the outlet 132B while being stirred by the spiral member 140 which rotates together with the discharge pipe 132. Thus, the raw material pieces MS are suppressed from becoming a lump during the transportation of the raw material pieces MS.

The raw material piece MS sent to the measurement portion 134 is put into the reception portion 160 through the upper opening portion 166. When the load cell 164 detects that the raw material pieces MS inside the reception portion 160 reach a predetermined target amount, the control apparatus 110 drives the opening and closing motor. As a result, the closing member 162 rotates from the closing position to the opening portion position, and the bottom opening portion 168 of the reception portion 160 is opened. When the bottom opening portion 168 is opened, the raw material piece MS from the reception portion 160 falls by the own weight of the raw material piece MS. The dropped raw material piece MS is transported to the defibration portion 20.

When the raw materials MS are transported through a hollow tube such as the discharge pipe 132, a configuration in which a transport member having a shaft rod is rotated to transport the raw material pieces MS may be provided instead of the configuration in which the raw materials MS are transported by the spiral member 140 which protrudes from the inner peripheral surface 132C. That is, it is considered that a transport member having a shaft rod such as a roller, or a transport member having a shaft rod provided with a protrusion around the shaft rod such as an auger is rotated inside the discharge pipe 132 to transport the raw material pieces MS. Meanwhile, the raw material piece MS as a fiber piece is easily bent, and in the transport member having such a shaft rod, the raw material piece MS is sandwiched in a gap between the inner peripheral surface 132C of the discharge pipe 132 and the transport member having the shaft rod and compressed, in some cases. Further, the raw material piece MS may be entangled with a shaft rod portion of the transport member having the shaft rod. For this reason, when trying to transport the raw material pieces MS by using the transport member having the shaft rod, the transport amount of raw material pieces MS varies, and transport unevenness is likely to occur.

On the other hand, in the present embodiment, since the spiral member 140 which protrudes from the inner peripheral surface 132C of the discharge pipe 132 is provided, a space is easily generated on the central axis L1 side inside the discharge pipe 132. Therefore, the raw material pieces MS can move toward the central axis L1 side inside the discharge pipe 132, and the raw material pieces MS are suppressed from being excessively compressed. Further, the raw material piece MS does not wrap around the transport member having the shaft rod. For this reason, it is easy to stably transport the raw material pieces MS inside the discharge pipe 132, and transport unevenness is suppressed. Therefore, the raw material pieces MS can be easily discharged from the outlet 132B in a state in which the transport unevenness is suppressed, and the raw material pieces MS can be discharged by a predetermined amount. Therefore, it is possible to prevent a large amount of raw material pieces MS from being discharged into the measurement portion 134 and exceeding the target amount at once, and it is possible to suppress transport unevenness to the downstream defibration portion 20.

In particular, in the present embodiment, the outlet 132B is provided with the rib 141, and the diameter of the outlet 132B is reduced. Therefore, it is easy to suppress the discharge of the raw material pieces MS from the outlet 132B, and it is easy to adjust the amount of raw material pieces MS discharged from the outlet 132B.

As described above, in the present embodiment, the storage portion 13 corresponding to an example of a fiber transport apparatus includes the case 170 having the internal space 170A which can accommodate the raw material pieces MS including fibers, and the discharge pipe 132 coupled to the discharge portion 186 of the case 170. Further, the storage portion 13 includes the transport motor 150 which rotates the discharge pipe 132 on the central axis L1. In the discharge pipe 132, one end in the axial direction communicates with the internal space 170A, and the other end has the outlet 132B which discharges the raw material pieces MS, and the spiral member 140 is provided on the inner peripheral surface 132C corresponding to an example of the inner surface of the discharge pipe 132. Therefore, since the transport member having the shaft rod is not disposed in the tube-shaped discharge pipe 132 in which the hollow transport path 133 is formed, it is suppressed that the raw material pieces MS may be entangled or compressed inside the discharge pipe 132. Therefore, in the present embodiment, the transport amount of raw material pieces MS is less likely to vary, and occurrence of transport unevenness can be reduced.

In the present embodiment, the spiral member 140 corresponding to an example of a protrusion is in a spiral shape and provided on the discharge pipe 132 with respect to the central axis L1. Therefore, by rotating the discharge pipe 132 in the forward direction RO on the central axis L1, the raw material pieces MS can be transported in a spiral shape of the spiral member 140.

Further, in the present embodiment, the rib 141 is formed at a peripheral portion of the outlet 132B in the discharge pipe 132. Therefore, the diameter of the outlet 132B can be reduced, the discharge amount of raw material pieces MS can be easily adjusted, and variation in the discharge amount of raw material pieces MS can be suppressed.

Further, in the present embodiment, the discharge pipe 132 is inclined such that the outlet 132B is lower in a vertically downward direction than the discharge portion 186 corresponding to an example of a coupling portion with the case 170. Therefore, the raw material pieces MS can be easily moved to the outlet 132B side by using gravity.

Further, in the present embodiment, the reception portion 160 which accommodates the raw material pieces MS is disposed below the outlet 132B. Therefore, the raw material pieces MS can be transported and accommodated in the reception portion 160 in the transport apparatus 131.

In the present embodiment, the load cell 164 which measures a weight of the raw material pieces MS accommodated in the reception portion 160 is disposed. Therefore, it is possible to measure the weight of the raw material pieces MS accommodated in the reception portion 160. Further, by measuring the weight, it is possible to send the raw material pieces MS having a predetermined weight to the downstream apparatus, for example, the defibration portion 20.

In the present embodiment, inside the case 170, there is provided the rotator 172 which rotates on a virtual rotation axis extending in a height direction of the case 170 and stirs the raw material pieces MS. In addition, the discharge pipe 132 is coupled to the case 170 at an overlapping position with the rotator 172 in the height direction of the case 170. Therefore, the raw material pieces MS stirred in the case 170 can efficiently flow into the discharge pipe 132.

2. Embodiment 2

2-1. Configuration of Discharge Pipe of Storage Portion

Next, Embodiment 2 according to the present disclosure will be described. The same components as those in above-described Embodiment 1 are denoted by the same reference numerals, and description thereof will not be repeated.

Figure 6:
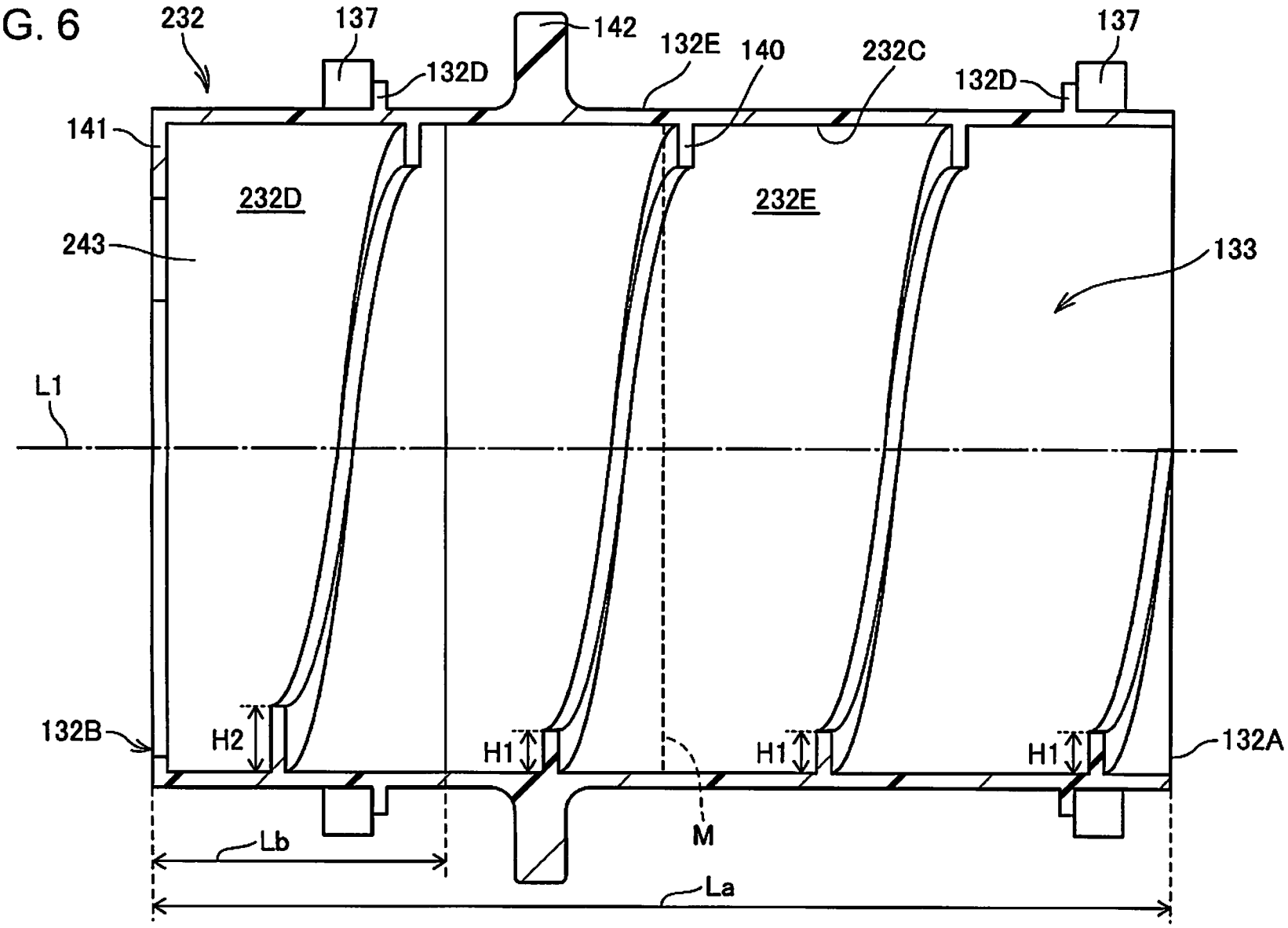
FIG. 6 is a cross-sectional view of a discharge pipe according to Embodiment 2.

FIG. 6 is a cross-sectional view of a discharge pipe 232 of Embodiment 2.

In the sheet manufacturing apparatus 100 of Embodiment 2, the discharge pipe 232 is provided instead of the discharge pipe 132 of Embodiment 1.

The discharge pipe 232 of Embodiment 2 is formed such that a coefficient of static friction on an inner peripheral surface 232C of the discharge pipe 232 on the outlet 132B side is smaller than a coefficient of static friction on a coupling portion side with the case 170, that is, on the inner peripheral surface 232C on the inlet 132A side in the discharge pipe 232. The coefficient of static friction corresponds to an example of a coefficient of friction. In the present embodiment, a thin plate-shaped film member 243 is attached to the inner peripheral surface 232C on the outlet 132B side. The film member 243 is attached by using an adhesive (not illustrated). A material of the film member 243 is, for example, PET resin. Instead of the PET resin, a material having a smaller coefficient of static friction than the ABS resin forming the inner peripheral surface 232C of the discharge pipe 132 may be used. It is known that a coefficient of static friction of a general ABS resin is 0.58. Here, the PET is an abbreviation of polyethylene terephthalate.

Therefore, in the discharge pipe 232, a low friction portion 232D covered with the film member 243 is formed at the outlet 132B side of the inner peripheral surface 232C. A high friction portion 232E in which the ABS resin is exposed and which has a higher coefficient of static friction than a coefficient of static friction of the low friction portion 232D is formed at the inlet 132A side of the inner peripheral surface 232C.

The low friction portion 232D is provided in a direction along the central axis L1 of the discharge pipe 232, that is, on the outlet 132B side from an intermediate position M which is an intermediate position of a total length La in the axial direction of the discharge pipe 232. The low friction portion 232D is desirably provided as a partial region of the discharge pipe 232 including the outlet 132B, and provided in a region having a length equal to or more than one pitch of the spiral member 140 from the outlet 132B in the axial direction. In the present embodiment, as an example, the total length La of the discharge pipe 232 in the axial direction is 240 mm, and a length Lb in the axial direction from the outlet 132B of the low friction portion 232D is 70 mm.

In the present embodiment, the film member 243 is attached to reduce a friction coefficient of the inner peripheral surface 232C on the outlet 132B side in the discharge pipe 232. Meanwhile, for example, the discharge pipe 232 may be formed of two different resins so that the outlet 1328 side has a smaller friction coefficient than the inlet 132A side.

2-2. Operation of Discharge Pipe of Storage Portion

In the discharge pipe 232 of the storage portion 13 of Embodiment 2, the raw material pieces MS flowing from the inlet 132A are transported through the high friction portion 232E of the discharge pipe 232. In the high friction portion 232E, the raw material pieces MS move so as to follow rotation of the discharge pipe 232 by frictional force with the high friction portion 232E, and the raw material pieces MS are easily transported while being largely stirred. When the raw material piece MS is transported to the low friction portion 232D beyond the intermediate position M, in the low friction portion 232D, the raw material piece MS easily slides on the discharge pipe 232 and is easily transported in a state of being accumulated on the lower side inside the discharge pipe 232.

Figure 7:
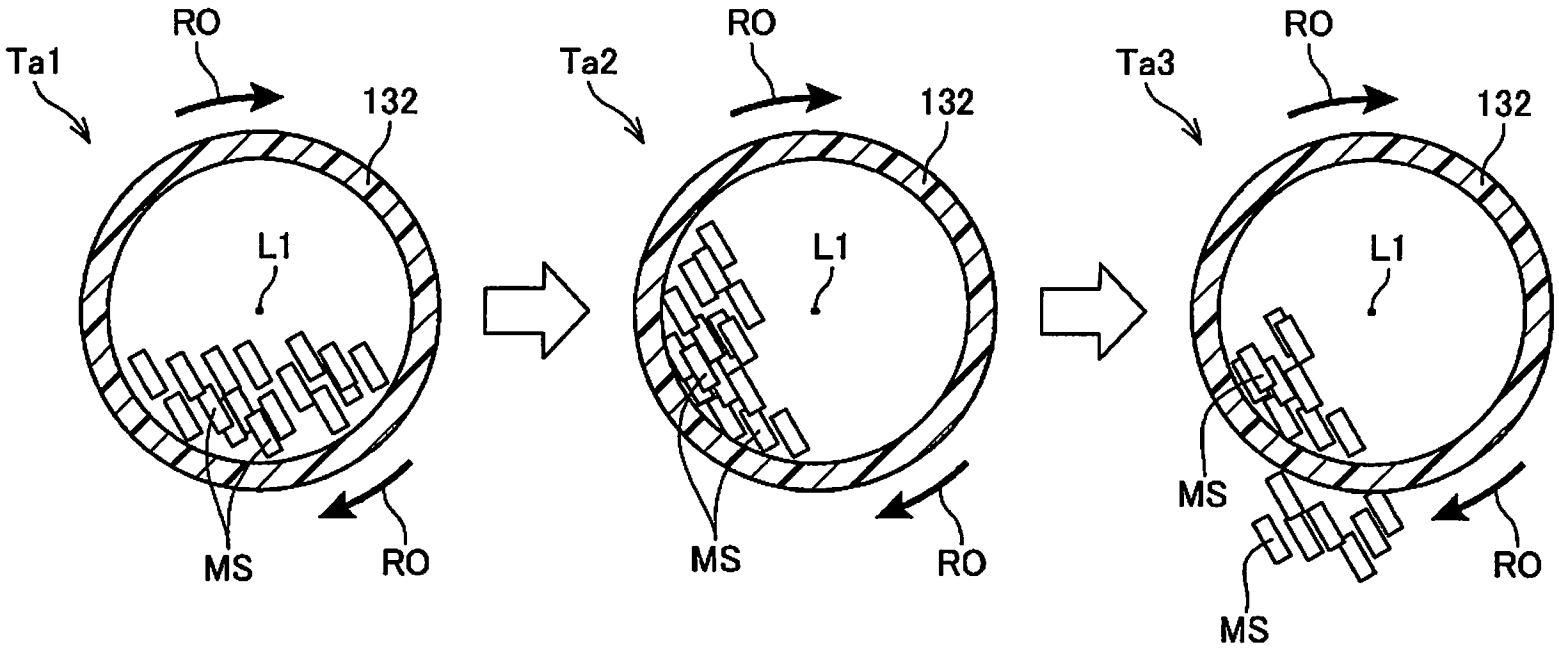
FIG. 7 is a schematic diagram illustrating movement of raw material pieces inside a discharge pipe without a low friction portion.
Figure 8:
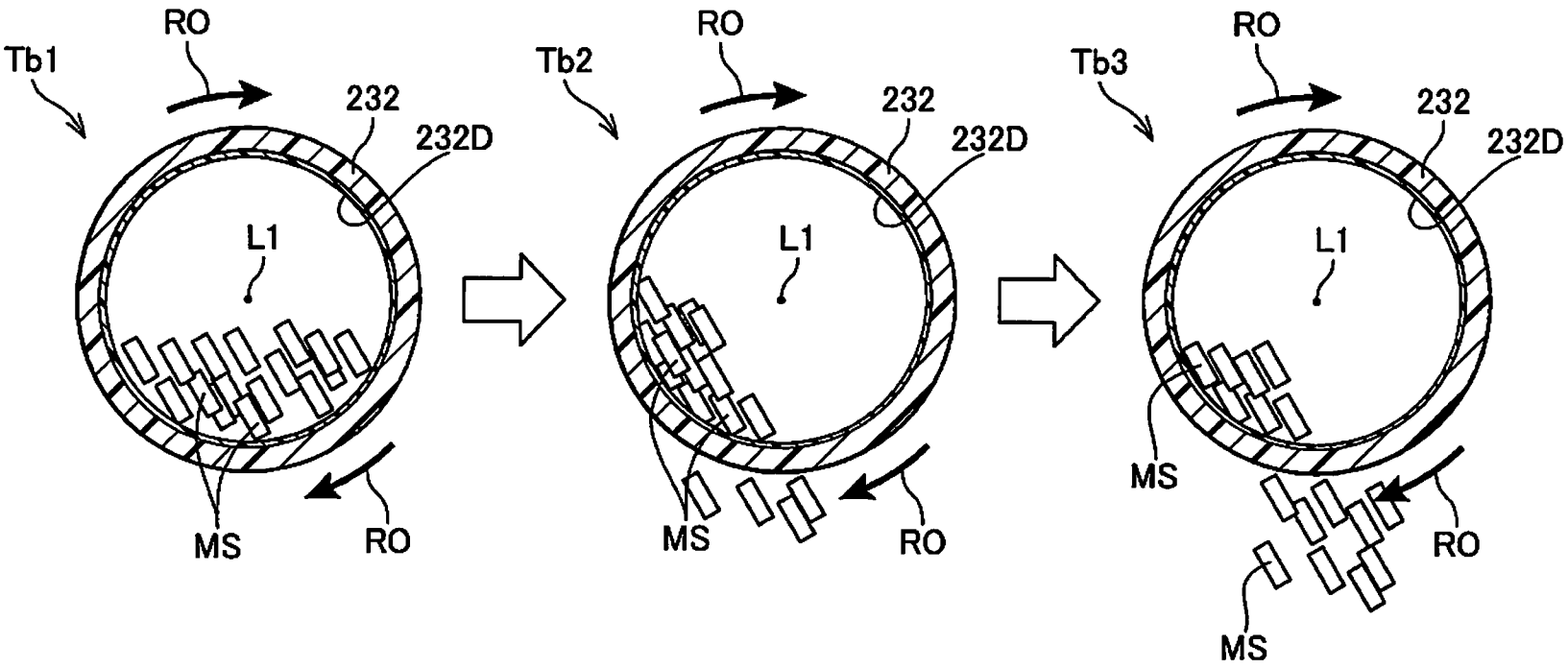
FIG. 8 is a schematic diagram illustrating raw material pieces inside a discharge pipe having the low friction portion.

FIG. 7 is a schematic diagram illustrating movement of the raw material pieces MS inside the discharge pipe 132 without the low friction portion 232D. FIG. 8 is a schematic diagram illustrating the raw material pieces MS inside the discharge pipe 232 having the low friction portion 232D.

When the low friction portion 232D is not provided on the outlet 132B side, as illustrated by arrows Ta1 and Ta2 in FIG. 7, the raw material pieces MS transported on the lower side inside the discharge pipe 132 easily move together with the inner peripheral surface 132C as the discharge pipe 132 rotates in the forward direction RO. For this reason, the raw material pieces MS move from the lower side to the upper side inside the discharge pipe 132, and in some cases, it is difficult for the raw material pieces MS to be discharged from the outlet 132B. When the discharge pipe 132 further rotates, as illustrated by an arrow Ta3, the raw material pieces MS collapse or the like and move to the lower portion of the discharge pipe 132, and the raw material pieces MS are discharged from the outlet 132B. That is, there is a case where the transport amount of raw material pieces MS discharged from the outlet 132B is easily vary.

On the other hand, in the present embodiment, since the low friction portion 232D is formed at the outlet 132B side, as illustrated by arrows Tb1 and Tb2 in FIG. 8, even when the discharge pipe 232 rotates, the raw material piece MS slide on the inner peripheral surface 232C and easily stay on the lower side of the discharge pipe 232. Therefore, as illustrated by arrows Tb2 and Tb3, the raw material pieces MS remaining on the lower side are easily discharged from the outlet 132B by a small amount as the discharge pipe 232 rotates. Therefore, variation in the discharge amount is easily suppressed, and transport unevenness is easily suppressed.

In particular, in the present embodiment, the low friction portion 232D is formed only at the outlet 132B side from the intermediate position M, and is not formed at the inlet 132A side from the intermediate position M. Thus, the raw material pieces MS flowing into the inlet 132A side can be stirred in the high friction portion 232E until the raw material pieces MS exceed the intermediate position M. The sufficiently stirred raw material pieces MS stay on the lower side of the discharge pipe 132 by the low friction portion 232D, so that it is possible to discharge the material pieces MS from the outlet 132B by a small amount.

As described above, also in Embodiment 2, the raw material pieces MS are transported by rotating the discharge pipe 232 instead of transporting the raw material pieces MS by the transport member having the shaft rod. Therefore, also in the present embodiment, in the same manner as Embodiment 1, the transport amount of raw material pieces MS is less likely to vary, and occurrence of transport unevenness can be suppressed.

In the present embodiment, the low friction portion 232D is provided on the inner peripheral surface 232C on the outlet 132B side of the discharge pipe 232. The friction coefficient of the low friction portion 232D is lower than the inner peripheral surface 232C in the discharge pipe 232 on the discharge portion 186 side of the case 170. Therefore, even when the discharge pipe 232 is rotated, the raw material pieces MS are easily accumulated on the lower side, and the raw material pieces MS are easily discharged from the outlet 132B by a small amount.

3. Embodiment 3

3-1. Configuration of Discharge Pipe of Storage Portion

Next, Embodiment 3 according to the present disclosure will be described. The same components as those in above-described Embodiment 2 are denoted by the same reference numerals, and description thereof will not be repeated.

Figure 9:
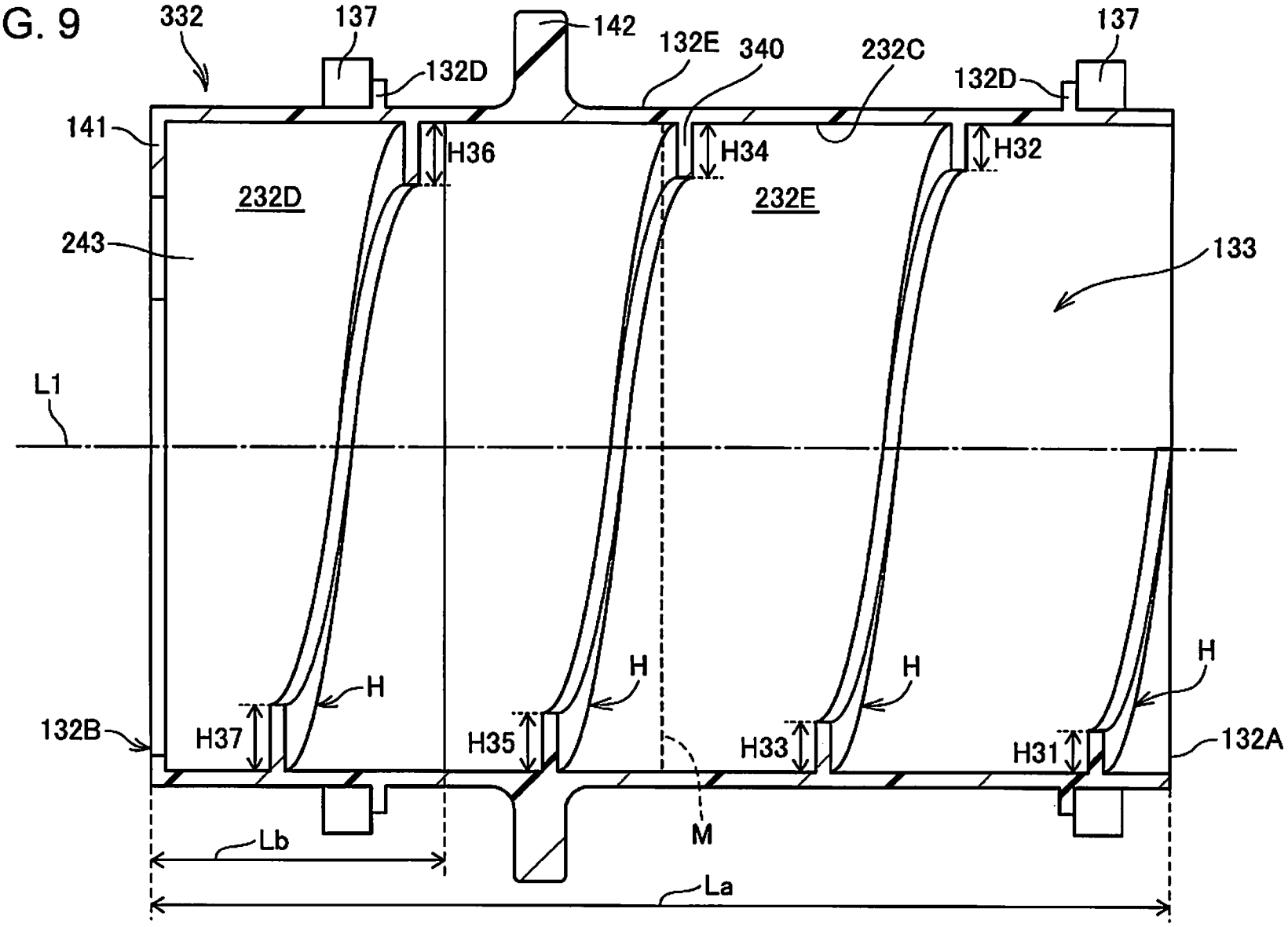
FIG. 9 is a cross-sectional view of a discharge pipe according to Embodiment 3.

FIG. 9 is a cross-sectional view of a discharge pipe 332 according to Embodiment 3.

In the sheet manufacturing apparatus 100 of Embodiment 3, the discharge pipe 332 is provided instead of the discharge pipe 232 of Embodiment 2.

The discharge pipe 332 of Embodiment 3 includes a spiral member 340 instead of the spiral member 140 of Embodiment 2. A height H of the spiral member 340 is gradually increased from the inlet 132A toward the outlet 132B. That is, for heights H31 to H37 of the spiral member 340 illustrated in FIG. 9, a relationship of H31<H32<H33<H34<H35<H36<H37 is satisfied. In the present embodiment, as an example, the height H of an end of the spiral member 340 at an end on the inlet 132A side is set to 5 mm. Further, the height H of an end of the spiral member 340 at an end on the outlet 132B side is set to 10 mm.

3-2. Operation of Discharge Pipe of Storage Portion

In the discharge pipe 332 of the storage portion 13 of Embodiment 3, the raw material pieces MS flowing from the inlet 132A are transported while being stirred by the spiral member 340 as the discharge pipe 332 rotates, and are discharged from the outlet 132B.

In the discharge pipe 332 of the present embodiment, the height H of the spiral member 340 is increased as the spiral member 340 approaches the outlet 132B, and a diameter of the transport path 133 is decreased as the spiral member 340 approaches the outlet 132B. Therefore, as the raw material pieces MS are transported to the outlet 132B side, the transport of the raw material pieces MS in the axial direction is suppressed, and it is easy to suppress a large amount of raw material pieces MS being discharged at one time. Therefore, in the present embodiment, the raw material pieces MS are easily discharged from the outlet 132B by a small amount, it is easy to suppress variation in the discharge amount, and it is easy to suppress transport unevenness.

As described above, also in Embodiment 3, the raw material pieces MS are transported by rotating the discharge pipe 332 instead of transporting the raw material pieces MS by the transport member having the shaft rod. Therefore, also in the present embodiment, in the same manner as Embodiment 1, the transport amount of raw material pieces MS is less likely to vary, and occurrence of transport unevenness can be reduced.

4. Embodiment 4

4-1. Configuration of Discharge Pipe of Storage Portion

Next, Embodiment 4 according to the present disclosure will be described. The same components as those in above-described Embodiment 2 are denoted by the same reference numerals, and description thereof will not be repeated.

Figure 10:
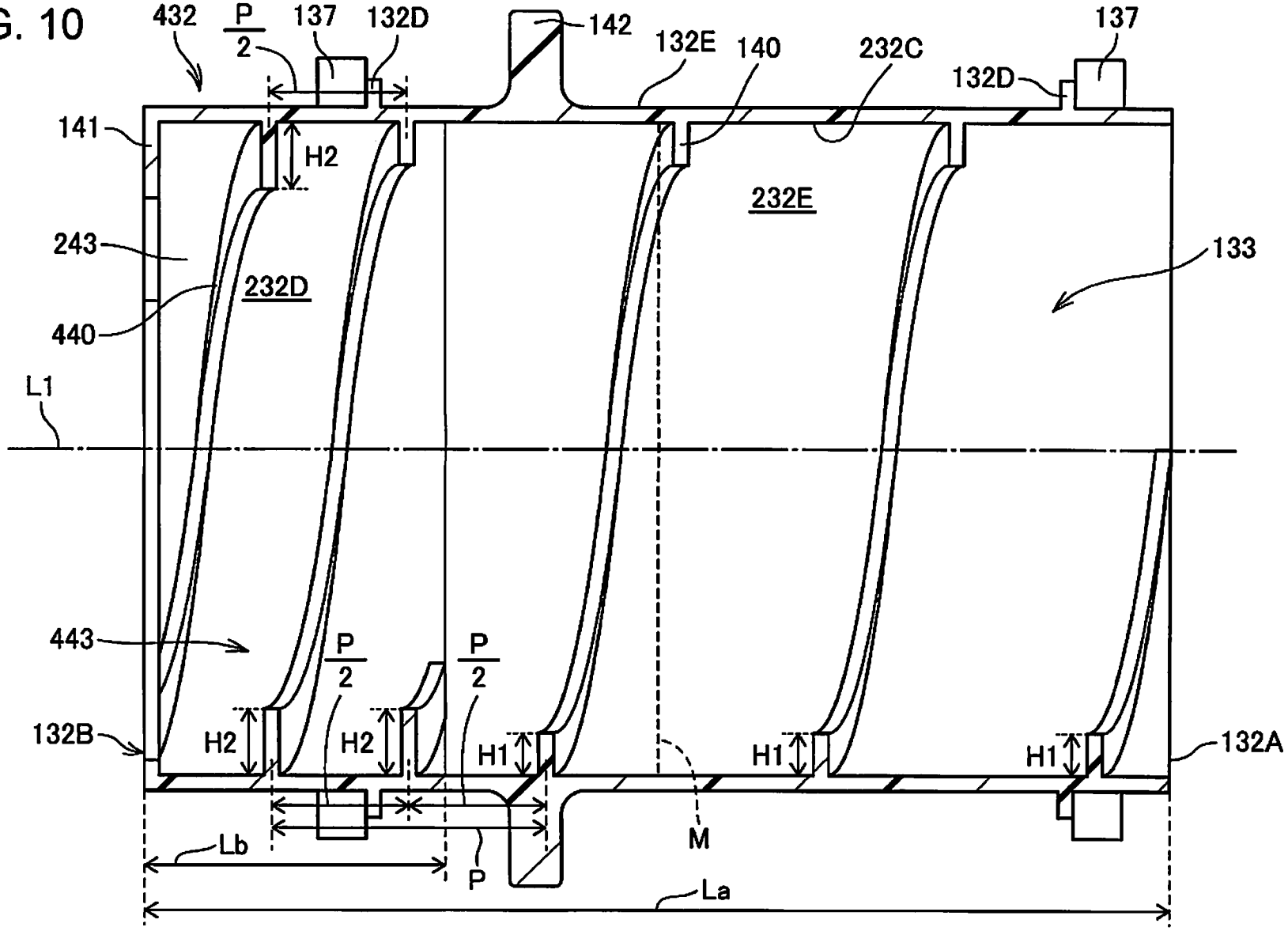
FIG. 10 is a cross-sectional view of a discharge pipe according to Embodiment 4.

FIG. 10 is a cross-sectional view of a discharge pipe 432 according to Embodiment 4.

In the sheet manufacturing apparatus 100 of Embodiment 4, the discharge pipe 432 is provided instead of the discharge pipe 232 of Embodiment 2.

In the discharge pipe 432 of Embodiment 4, a second spiral member 440 is added. The second spiral member 440 corresponds to an example of a second protrusion. The second spiral member 440 has a shape in which a thin plate having a rectangular cross-section draws a spiral. The second spiral member 440 is disposed along the inner peripheral surface 232C of the discharge pipe 432. The second spiral member 440 is provided within a range of the length Lb from the outlet 132B in the axial direction.

The second spiral member 440 has a same pitch P as the pitch of the spiral member 140, and the second spiral member 440 is displaced from the spiral member 140 by a half cycle in a rotation direction of the discharge pipe 432. In the present embodiment, the second spiral member 440 is formed in the same manner as the spiral member 140 except that a length in the axial direction is short and the second spiral member 440 is displaced in the rotation direction. That is, the second spiral member 440 has the same shape as the spiral member 140 within the range of the length Lb from the outlet 132B in the axial direction. The spiral member 140 corresponds to an example of a first protrusion.

The second spiral member 440 is desirably provided at the outlet 132B side from the intermediate position M. The number of turns of the second spiral member 440 is desirably equal to or more than one pitch. The spiral member 140 and the second spiral member 440 form a double spiral portion 443 within the range of the length Lb on the outlet 132B side of the discharge pipe 432.

The second spiral member 440 desirably has the above-described configuration. Meanwhile, the second spiral member 440 may not have the same shape as the spiral member 140 and may not have the configuration in which the second spiral member 440 is displaced by a half cycle in the rotation direction.

4-2. Operation of Discharge Pipe of Storage Portion

In the discharge pipe 432 of the storage portion 13 of Embodiment 4, the raw material pieces MS flowing from the inlet 132A are transported while being stirred by the spiral member 140 as the discharge pipe 432 rotates. When the raw material pieces MS are transported to the outlet 132B side beyond the intermediate position M, the raw material pieces MS are transported while being stirred by the double spiral portion 443 provided by the spiral member 140 and the second spiral member 440, and discharged from the outlet 132B.

Here, when the second spiral member 440 is not provided, the spiral member 140 passes below the central axis L1 at the outlet 132B one time while the discharge pipe makes one rotation. On the other hand, in the present embodiment in which the spiral member 140 and the second spiral member 440 are provided, the spiral member 140 and the second spiral member 440 pass below the central axis L1 two times while the discharge pipe 432 makes one rotation. In general, the raw material pieces MS are easily discharged when the spiral member 140 and the second spiral member 440 near the outlet 132B pass below the central axis L1. For this reason, in the present embodiment, it is possible to increase a discharge timing of the raw material pieces MS per rotation. Further, the raw material pieces MS transported from the upstream can be divided by two of the spiral member 140 and the second spiral member 440 and discharged. Therefore, as compared with the case where the raw material pieces MS are transported by one spiral member 140, it becomes easier to perform the discharge while the discharge amount per unit time is equalized, and transport unevenness is easily suppressed.

As described above, also in Embodiment 4, the raw material pieces MS are transported by rotating the discharge pipe 432 instead of transporting the raw material pieces MS by the transport member having the shaft rod. Therefore, also in the present embodiment, in the same manner as Embodiment 1, the transport amount of raw material pieces MS is less likely to vary, and occurrence of transport unevenness can be reduced.

In the present embodiment, the protrusion has the spiral member 140 having a spiral shape and the second spiral member 440 having a spiral shape. The spiral member 140 and the second spiral member 440 are provided on the outlet 132B side, which is a part of the discharge pipe 432 including the outlet 132B. Therefore, it is possible to increase the discharge timing of the raw material pieces MS by the spiral member 140 and the second spiral member 440 of the discharge pipe 432 per rotation.

In the present embodiment, the second spiral member 440 has the same pitch P as the pitch of the spiral member 140, and the second spiral member 440 is displaced from the spiral member 140 by a half cycle in a rotation direction of the discharge pipe 432. Therefore, by providing the spiral member 140 and the second spiral member 440 having the same spiral shape, it becomes easier to perform the discharge while the discharge amount per unit time is equalized.

5. Embodiment 5

5-1. Configuration of Discharge Pipe of Storage Portion

Next, Embodiment 5 according to the present disclosure will be described. The same components as those in above-described Embodiment 2 are denoted by the same reference numerals, and description thereof will not be repeated.

Figure 11:
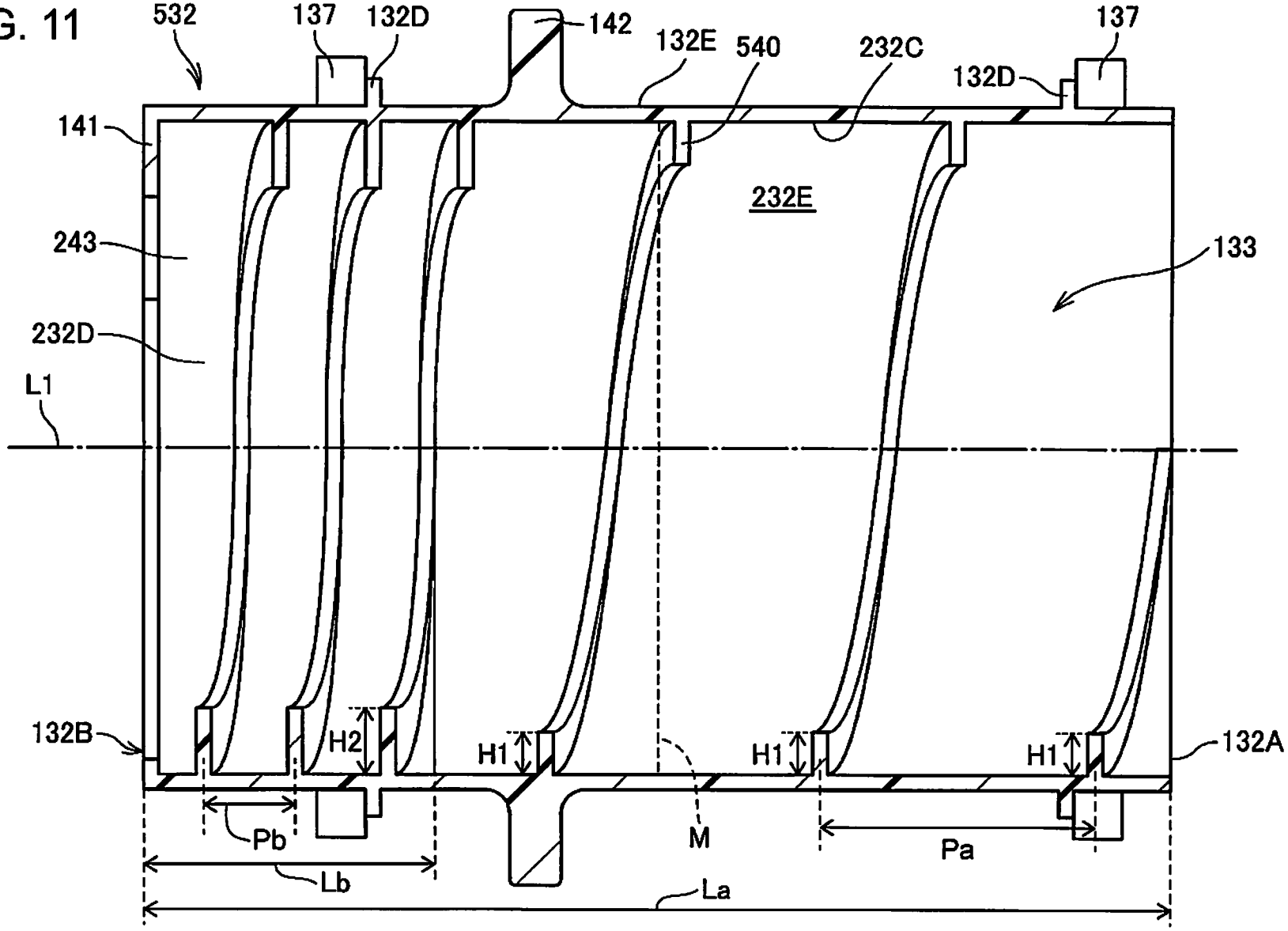
FIG. 11 is a cross-sectional view of a discharge pipe according to Embodiment 5.

FIG. 11 is a cross-sectional view of a discharge pipe 532 according to Embodiment 5.

In the sheet manufacturing apparatus 100 of Embodiment 5, the discharge pipe 532 is provided instead of the discharge pipe 232 of Embodiment 2.

The discharge pipe 532 of Embodiment 5 includes a spiral member 540 instead of the spiral member 140 of Embodiment 2. In the spiral member 540, a pitch Pb on the outlet 132B side is shorter than a pitch Pa on the inlet 132A side. In the present embodiment, the spiral member 540 is formed in a spiral shape with the pitch Pb as a part of the length Lb from the outlet 132B in the axial direction. The spiral member 540 may have a spiral shape with the pitch Pb as a part on the outlet 132B side from the intermediate position M.

5-2. Operation of Discharge Pipe of Storage Portion

In the discharge pipe 532 of the storage portion 13 of Embodiment 5, the raw material pieces MS flowing from the inlet 132A are transported while being stirred by the spiral member 540 as the discharge pipe 532 rotates, and are discharged from the outlet 132B.

In the present embodiment, the spiral member 540 has the long pitch Pa on the inlet 132A side and the short pitch Pb on the outlet 132B side. In general, the shorter the pitches Pa and Pb, the smaller the transport amount by the spiral member 540 along the central axis L1 direction. Therefore, on the outlet 132B side having the short pitch Pb, the transport of the raw material pieces MS in the axial direction is suppressed, and the discharge of a large amount of raw material pieces MS at one time is easily suppressed. Therefore, in the present embodiment, the raw material pieces MS are easily discharged from the outlet 132B by a small amount, it is easy to suppress variation in the discharge amount, and it is easy to suppress transport unevenness.

As described above, also in Embodiment 5, the raw material pieces MS are transported by rotating the discharge pipe 532 instead of transporting the raw material pieces MS by the transport member having the shaft rod. Therefore, also in the present embodiment, in the same manner as Embodiment 1, the transport amount of raw material pieces MS is less likely to vary, and occurrence of transport unevenness can be reduced.

6. Embodiment 6

6-1. Configuration of Storage Portion

Next, Embodiment 6 according to the present disclosure will be described. The same components as those in above-described Embodiment 1 are denoted by the same reference numerals, and description thereof will not be repeated.

Figure 12:
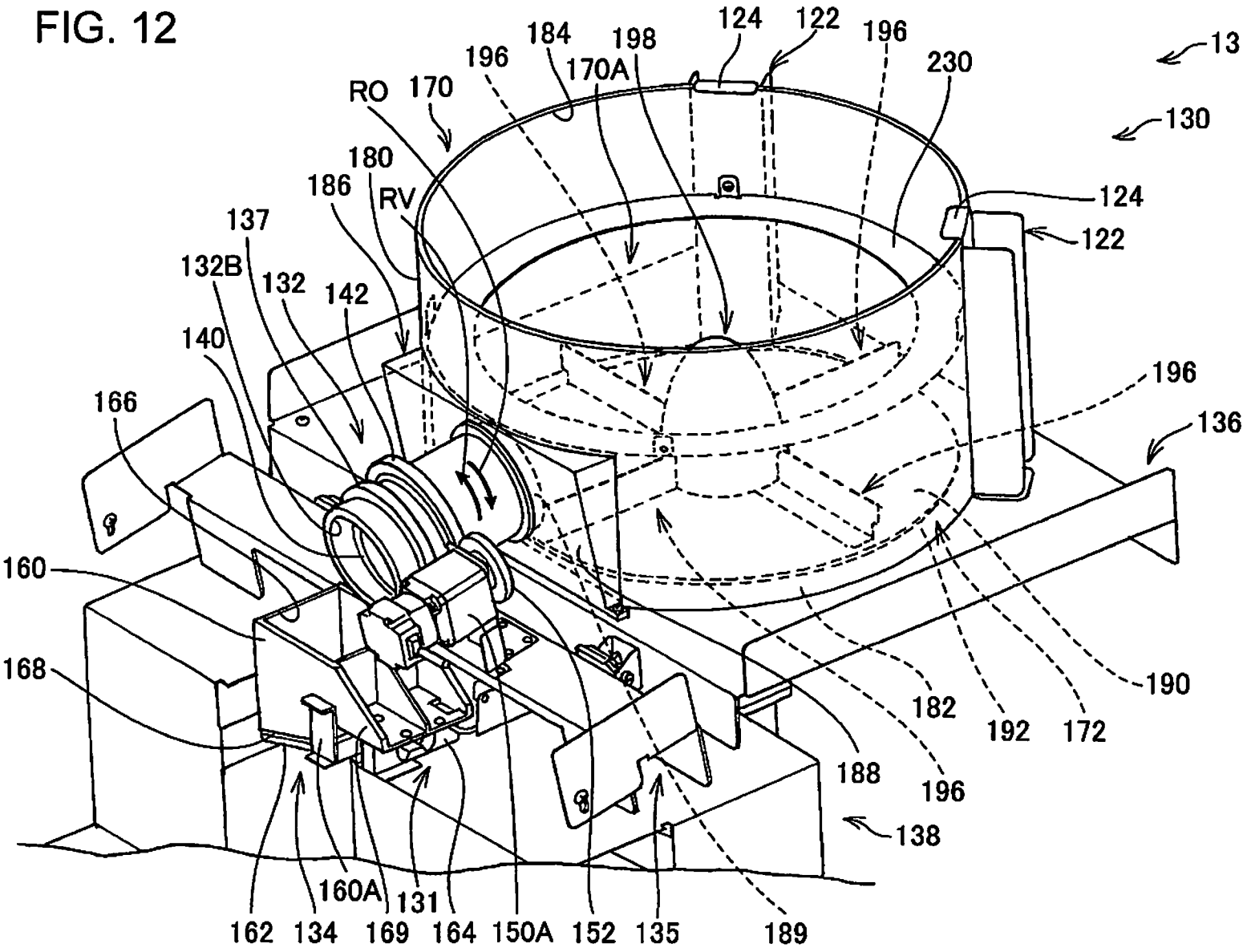
FIG. 12 is a perspective view of a storage portion according to Embodiment 6.
Figure 13:
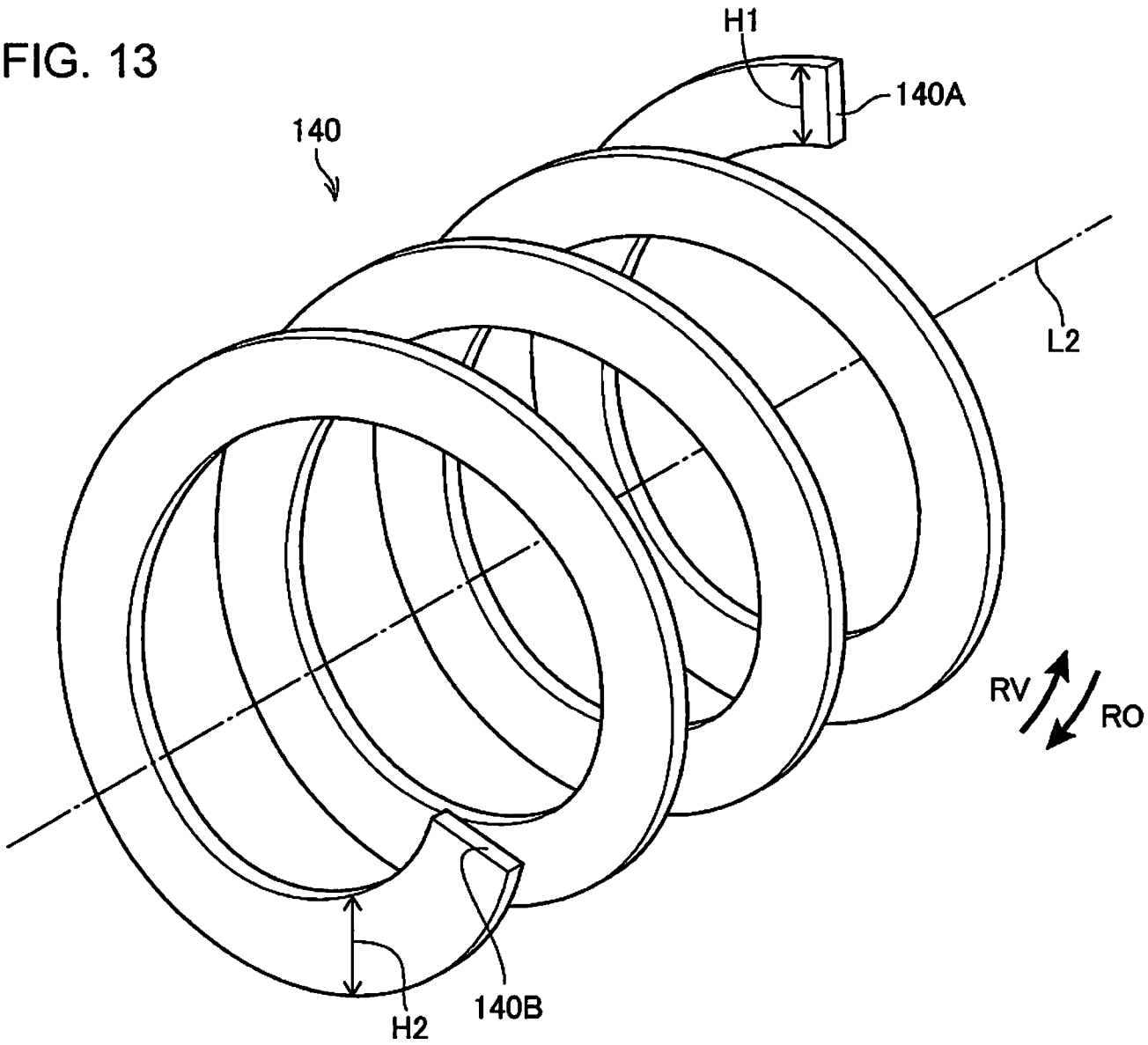
FIG. 13 is a perspective view of a spiral member.

FIG. 12 is a perspective view of the storage portion 13 according to Embodiment 6, and FIG. 13 is a perspective view of the spiral member 140 according to Embodiment 6.

In a sheet manufacturing apparatus 100A according to Embodiment 6, a transport motor 150A is provided instead of the transport motor 150 of Embodiment 1.

The driven gear 142 of the present embodiment is coupled to the transport motor 150A installed on the upper surface of the pipe support member 135. Here, the transport motor 150A corresponds to an example of a driving portion. The drive gear 152 is attached to a drive shaft of the transport motor 150A, and the drive gear 152 meshes with the driven gear 142. When the transport motor 150A rotates the drive shaft, the discharge pipe 132 rotates on the central axis L1. The transport motor 150A can rotate in a forward direction and in a reverse direction as described below, and can control a rotation direction of the discharge pipe 132 by controlling a rotation direction of the transport motor 150A. Here, the rotation direction of the discharge pipe 132 is a forward direction RO or a reverse direction RV.

The transport apparatus 131 which transports the raw material pieces MS is configured to include the discharge pipe 132, the spiral member 140, the driven gear 142, the transport motor 150A, the drive gear 152, and the like.

The discharge pipe 132 rotates at a speed corresponding to a rotation speed of the transport motor 150A. The rotation speed of the discharge pipe 132 affects the transport amount of raw material pieces MS transported by the discharge pipe 132. The control apparatus 110 controls rotation of the transport motor 150A such that the rotation speed of the discharge pipe 132 is within an appropriate range.

The rotation speed of the discharge pipe 132, that is, the number of revolutions per unit time is the same as in the above-described embodiment.

The rotation direction of the discharge pipe 132 affects the transport amount of raw material pieces MS transported by the discharge pipe 132. The control apparatus 110 changes the rotation direction of the transport motor 150A so that the rotation speed of the discharge pipe 132 is within the appropriate range.

Figure 14:
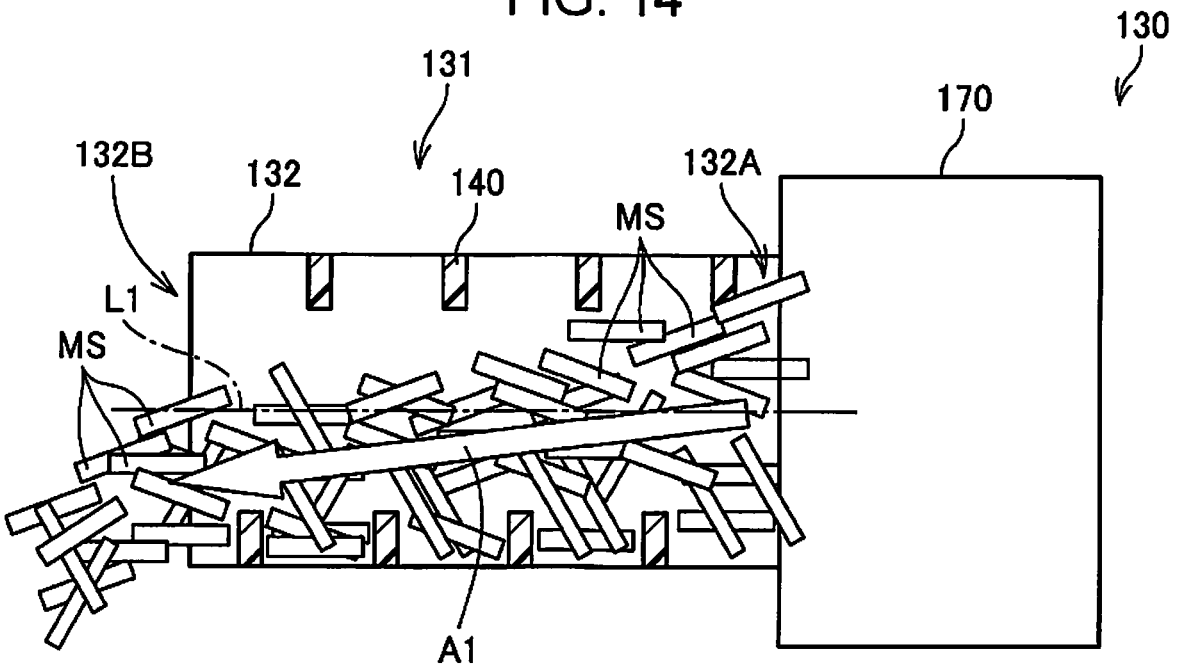
FIG. 14 is an explanatory diagram illustrating movement of raw material pieces when a discharge pipe rotates in a forward direction.
Figure 15:
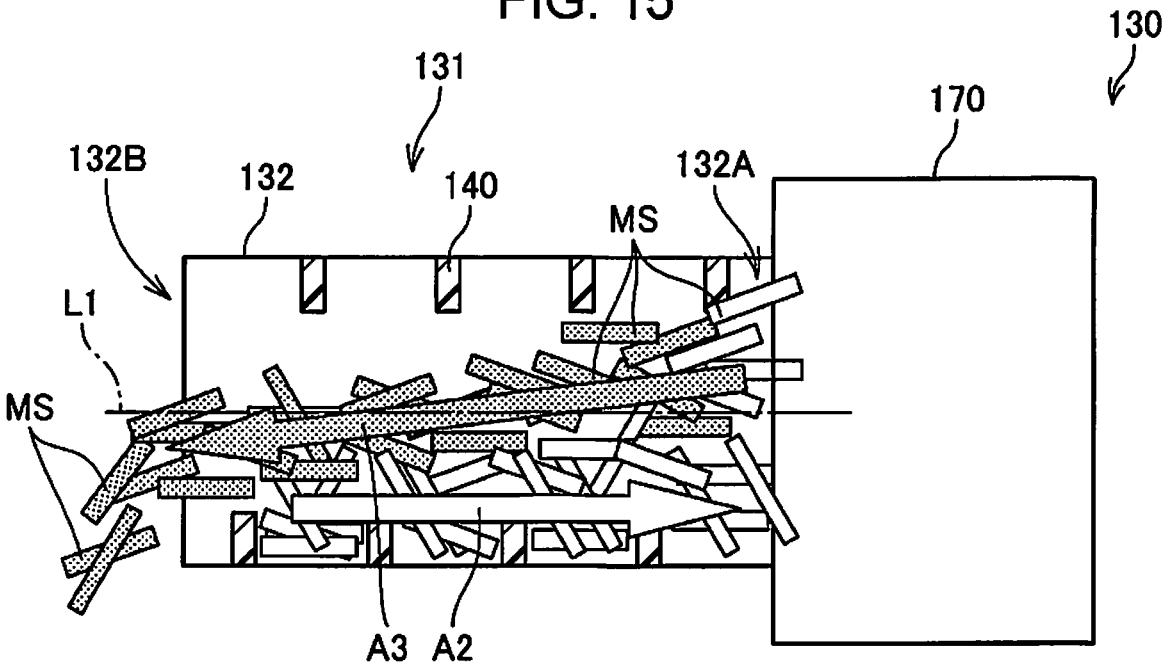
FIG. 15 is an explanatory diagram illustrating movement of the raw material pieces when the discharge pipe rotates in a reverse direction.

FIG. 14 is an explanatory diagram illustrating movement of the raw material pieces MS when the discharge pipe 132 rotates in the forward direction RO, and FIG. 15 is an explanatory diagram illustrating movement of the raw material pieces MS when the discharge pipe 132 rotates in the reverse direction RV.

The spiral member 140 stirs the raw material pieces MS inside the discharge pipe 132 both when the discharge pipe 132 rotates in the forward direction RO and when the discharge pipe 132 rotates in the reverse direction RV. Thus, an effect is obtained that the raw material pieces MS in lumps unravel, and the raw material pieces MS are easily moved inside the discharge pipe 132.

When the discharge pipe 132 rotates in the forward direction RO, the spiral member 140 inside the discharge pipe 132 acts in a direction of sending out the raw material pieces MS from the inlet 132A to the outlet 132B. For this reason, the raw material pieces MS are quickly transported to the outlet 132B as illustrated by an arrow A1.

On the other hand, when the discharge pipe 132 rotates in the reverse direction RV, the spiral member 140 acts to send the raw material pieces MS from the outlet 132B toward the inlet 132A as illustrated by an arrow A2. Meanwhile, since the raw material pieces MS stored in the case 170 exist and stay at the inlet 132A, the raw material pieces MS existing inside the discharge pipe 132 suppress the outflow of the raw material pieces MS from the discharge pipe 132 to the case 170. As a result, most of the raw material pieces MS inside the discharge pipe 132 remain inside the discharge pipe 132 while being stirred by the spiral member 140.

Further, inside the discharge pipe 132, the action of the spiral member 140 to send the raw material piece MS toward the inlet 132A is less likely to act on the raw material piece MS located at a position higher than the widths H1 and H2 of the spiral member 140. That is, in FIG. 15, the raw material pieces MS located closer to the central axis L1 than the spiral member 140 do not contact with the spiral member 140, and thus are less likely to be transported by the spiral member 140. When the discharge pipe 132 is inclined, these raw material pieces MS move toward the outlet 132B along the inclination of the discharge pipe 132 as illustrated by an arrow A3. Such movement of the raw material piece MS in the direction of the arrow A3 is promoted as the spiral member 140 stirs the raw material pieces MS. As a result, even when the discharge pipe 132 rotates in the reverse direction RV, the raw material pieces MS are discharged from the outlet 132B. In this case, the amount of raw material pieces MS discharged from the outlet 132B is smaller than that in the case where the discharge pipe 132 rotates in the forward direction RO, as much as the transport action by the spiral member 140 does not act.

Therefore, when the discharge pipe 132 rotates, the raw material pieces MS are discharged from the outlet 132B regardless of whether the rotation direction is the forward direction RO or the reverse direction RV. The control apparatus 110 can adjust the discharge amount of raw material pieces MS discharged from the outlet 132B by switching the rotation direction of the discharge pipe 132 between the forward direction RO and the reverse direction RV, as described below.

The action of sending out the raw material pieces MS by the rotation of the discharge pipe 132 is hardly affected by specific gravity of the raw material pieces MS. As described below, a weight of one piece of the raw material piece MS is changed depending on a thickness and specific gravity of the raw material MA. On the other hand, even when the weight of one raw material piece MS changes, a change in the number of raw material pieces MS discharged from the discharge pipe 132 is small. That is, a change in the discharge amount of raw material pieces MS depending on the rotation direction of the discharge pipe 132 can be referred to as a change in the number of discharged raw material pieces MS. The sheet manufacturing apparatus 100A can adjust the number of raw material pieces MS discharged from the outlet 132B per unit time by switching the rotation direction of the discharge pipe 132 between the forward direction RO and the reverse direction RV. In the following description, the operation of rotating the discharge pipe 132 in the forward direction RO is referred to as forward rotation, and the operation of rotating the discharge pipe 132 in the reverse direction RV is referred to as reverse rotation.

The bottom opening portion 168 is open on the bottom surface of the reception portion 160, and the closing member 162 is attached to the bottom opening portion 168.

The closing member 162 is rotatably attached by the shaft 160A. The closing member 162 is rotatable between a closing position for closing the bottom opening portion 168 and an opening position for opening the bottom opening portion 168 by power of an opening and closing motor 165 to be described below. That is, the bottom opening portion 168 of the reception portion 160 is opened and closed by an operation of the opening and closing motor 165. When the bottom opening portion 168 is opened, the raw material pieces MS stored in the reception portion 160 are discharged and sent to the defibration portion 20. The bottom opening portion 168 may be opened and closed by a sliding plate member.

The load cell 164 is a sensor which measures a weight or a force such as torque. In the configuration illustrated in FIG. 12, the load cell 164 measures a force applied via the protrusion portion 169 and outputs a signal corresponding to the measured value to the control apparatus 110.

6-2. Operation According to Type of Raw Material

As described above, various types of raw materials MA can be used in the sheet manufacturing apparatus 100A. Meanwhile, the inventor obtains the knowledge that a transport state of the raw material pieces MS differs depending on types of the raw materials MA. As a specific example, when a basis weight or specific gravity of the raw material MA is different, a weight per raw material piece MS is different, so that it is found that the amount of raw material piece MS discharged when the discharge pipe 132 is operated is different. Here, the amount of raw material pieces MS indicates a total weight of the raw material pieces MS.

Figure 16:
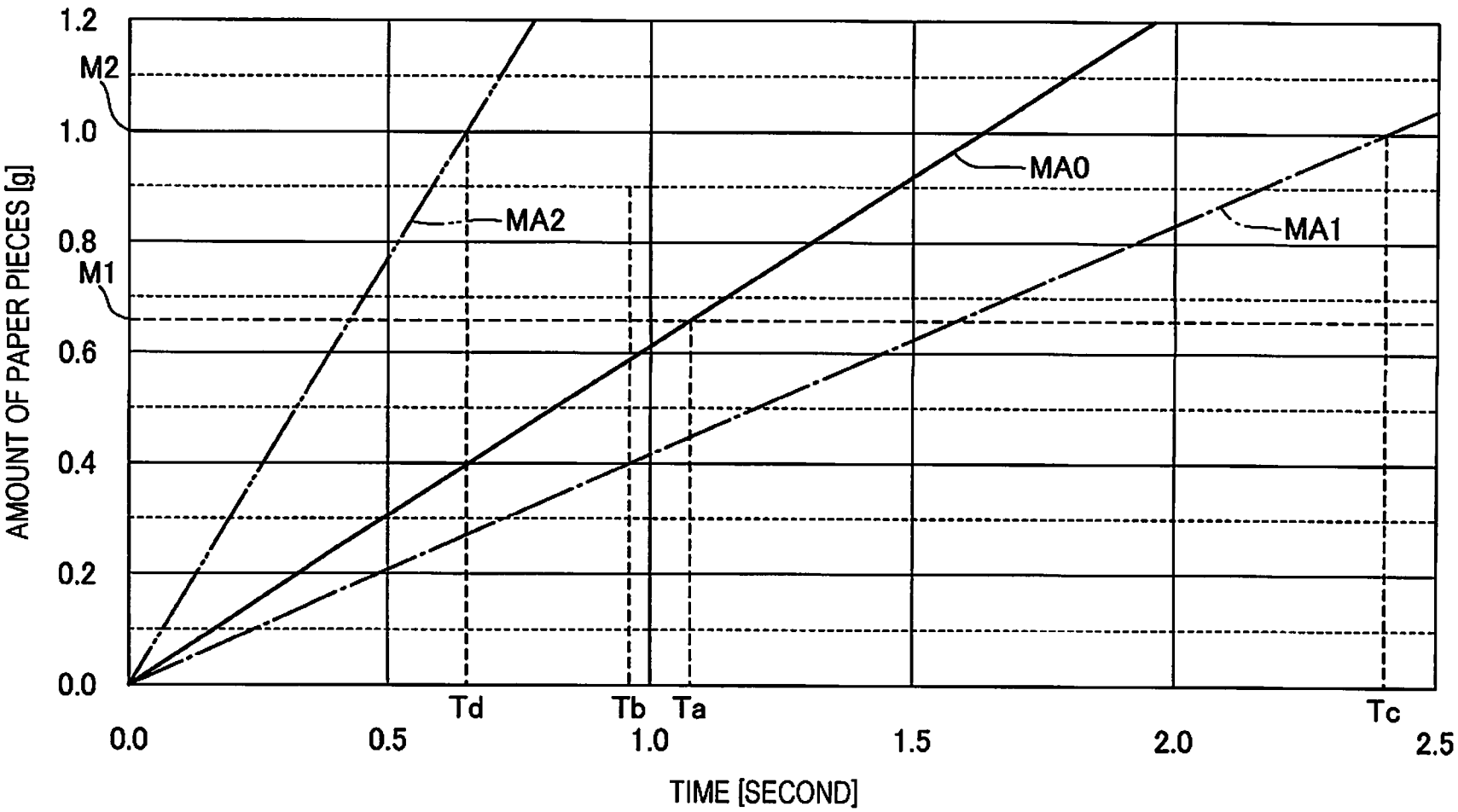
FIG. 16 is a chart illustrating a correlation between an operation time of a discharge pipe and the amount of raw material pieces discharged.

FIG. 16 is a chart illustrating a correlation between the amount of raw material pieces MS discharged when the discharge pipe 132 is rotated in the forward direction RO and a time, and the horizontal axis indicates an elapsed time and the vertical axis indicates the amount of raw material pieces MS discharged from the discharge pipe 132. The amount of raw material pieces MS is a value obtained from a measured value of the load cell 164. All three curves MA0, MA1, and MA2 illustrated in FIG. 16 illustrate a mode in which the amount of raw material pieces MS discharged from the outlet 132B increases while the discharge pipe 132 rotates.

The curve MA1 illustrates a change in the amount of raw material pieces MS when using plain paper as the raw material MA, and the curve MA2 illustrates a change in the amount of raw material pieces MS when using thick paper as the raw material MA. Here, the plain paper refers to a so-called PPC paper, for example, paper having a basis weight equal to or more than 60 $g/m^2$ and equal to or less than 80 $g/m^2$. It is known that a thickness of the PPC paper is approximately 90 μm to 100 μm. In addition, the thick paper refers to paper having a larger basis weight than the plain paper. When the thick paper is used as the raw material MA, the weight per raw material piece MS is heavier than the plain paper. As described above, the number of raw material pieces MS discharged from the discharge pipe 132 is hardly affected by a weight of each raw material piece MS, so that the total weight of the raw material pieces MS discharged when the thick paper is used as the raw material MA increases faster than when the plain paper is used. In FIG. 16, in the curve MA2, the weight of the raw material piece MS increases faster as the time elapses as compared with the curve MA1.

Here, reference amounts M1 and M2 are set as references for the discharge amount of raw material pieces MS, that is, the weight of the discharged raw material pieces MS.

When an elapsed time Tc until the discharge amount of raw material pieces MS reaches the reference amount M2 is calculated based on the curve MA1, an elapsed time Td until the discharge amount of raw material pieces MS reaches the reference amount M2 is calculated based on the curve MA2, and the elapsed time Tc is compared with elapsed time Td, the elapsed time Td is much shorter than the elapsed time Tc. With this result, it becomes clear that the number of raw material pieces MS transported by the discharge pipe 132 is hardly affected by the type of the raw material MA, and a difference in weight per raw material piece MS is a cause of the change in the amount of raw material pieces MS discharged from the discharge pipe 132.

The amount of defibrated material MB generated by the defibration portion 20 corresponds to the amount of fiber supplied to the defibration portion 20. In other words, the amount of defibrated material MB corresponds to the weight of the raw material pieces MS discharged from the discharge pipe 132.

Therefore, by controlling the weight of the raw material pieces MS discharged from the discharge pipe 132 per unit time to be within an appropriate range, it is possible to stabilize the amount of defibrated material MB generated per unit time, and it is possible to stabilize a quality of the sheet S manufactured by the sheet manufacturing apparatus 100A.

Therefore, in the sheet manufacturing apparatus 100A of the present embodiment, in order to determine a reference for determining the basis weight of the raw material MA, a boundary for distinguishing between a case where specific gravity of the raw material MA is large and a case where the specific gravity is small is determined. Specifically, in FIG. 16, the curve MA0 serving as a boundary for distinguishing the curve MA1 from the curve MA2 is obtained. The curve MA0 is a curve obtained such that, for example, an elapsed time until the reference amount M2 is reached is a value between the elapsed time Tc and the elapsed time Td. Since both the curves MA1 and MA2 in FIG. 16 are substantially straight lines, the curve MA0 can be obtained as a straight line.

The sheet manufacturing apparatus 100A obtains an elapsed time until the amount of raw material pieces MS reaches the reference amount M1, based on the curve MA0, and sets the elapsed time as a time threshold value Ta. The control apparatus 110 measures a time until the amount of raw material pieces MS obtained from the measured value of the load cell 164 reaches the reference amount M1, and compares the measured time with the threshold value Ta to determine whether specific gravity of the raw material MA is large or small. When the control apparatus 110 determines that the specific gravity of the raw material MA is large, the rotation direction of the discharge pipe 132 is switched to the reverse direction RV, so that the number of raw material pieces MS discharged from the outlet 132B per unit time is suppressed. Thus, it is possible to adjust the weight of the raw material pieces MS discharged from the discharge pipe 132 per unit time, and the amount of defibrated material MB generated by the defibration portion 20 is stabilized.

The type of the raw material MA supplied from the supply portion 10 is not always constant, and the type of the supplied raw material MA may change. In this case, there is a possibility that different types of raw material pieces MS are mixed in the case 170, and further, there is a possibility that distribution of the types of the raw material pieces MS is biased in the case 170. Due to these factors, the weight of the raw material pieces MS discharged from the discharge pipe 132 may fluctuate. Meanwhile, the sheet manufacturing apparatus 100A controls the rotation direction of the discharge pipe 132 with the threshold value Ta as a reference, so that it is possible to stabilize the amount of raw material pieces MS sent to the defibration portion 20.

Further, the transport amount of raw material pieces MS discharged from the discharge pipe 132 is changed under the influence of the rotation speed of the discharge pipe 132.

Figure 17:
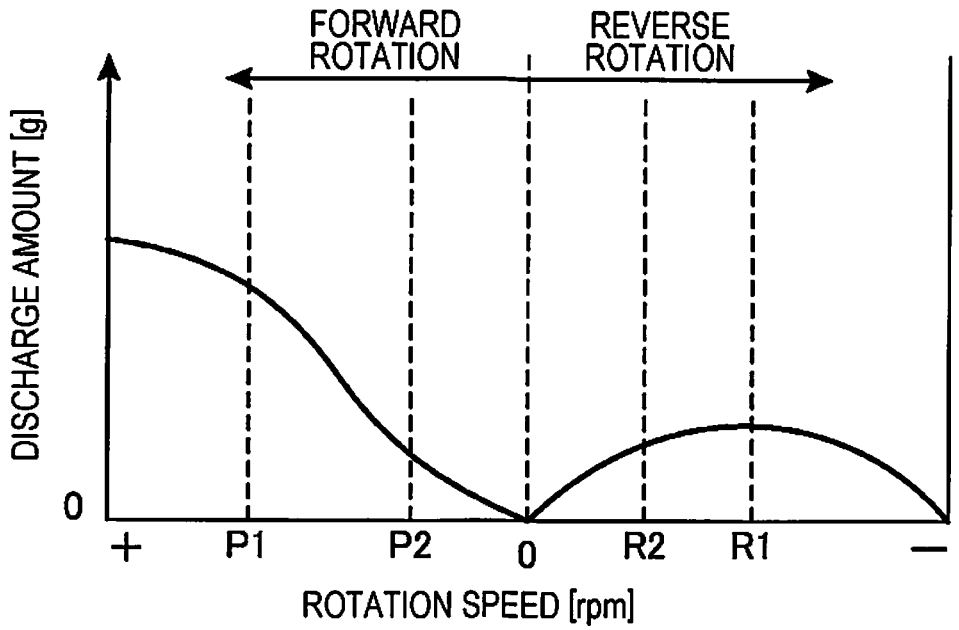
FIG. 17 is a chart illustrating a correlation between a rotation speed of the discharge pipe and the amount of raw material pieces discharged.

FIG. 17 is a table illustrating a correlation between the rotation speed of the discharge pipe 132 and the amount of discharged raw material pieces MS. In FIG. 17, the vertical axis indicates the amount of raw material pieces MS, and indicates a weight of the raw material pieces MS discharged from the outlet 132B per unit time. The correlation illustrated in FIG. 17 illustrates an example when one type of raw material MA is used, for example, when plain paper is used as the raw material MA.

The horizontal axis in FIG. 17 indicates the rotation speed of the discharge pipe 132. A center on the horizontal axis indicates zero speed, that is, a stop state of the discharge pipe 132, and the left side from the center indicates a forward rotation speed and the right side from the center indicates the reverse rotation speed in FIG. 17.

As illustrated in the left part in FIG. 17, when the rotation direction of the discharge pipe 132 is a forward direction, the correlation becomes clear that the higher the rotation speed, the larger the discharge amount of raw material pieces MS per unit time. On the other hand, as illustrated in the right half in FIG. 17, it becomes clear that when the rotation direction of the discharge pipe 132 is a reverse direction, the higher the rotation speed, the larger the discharge amount of raw material pieces MS per unit time, but as the rotation speed further decreases, the discharge amount of raw material pieces MS per unit time decreases. When the rotation direction is the reverse direction, it is considered that the factor is that the action of the raw material pieces MS being stuck to the inner wall of the discharge pipe 132 easily occurs due to centrifugal force.

In the sheet manufacturing apparatus 100A, a rotation speed P1 in the forward direction and a rotation speed R1 in the reverse direction are used as rotation speeds of the discharge pipe 132. The rotation speed P1 is, for example, 75 rpm described above, and the rotation speed R1 is, for example, 75 rpm in the reverse direction. The discharge amount of raw material pieces MS at the rotation speed R1 is smaller than that at the rotation speed P1. This indicates that the amount of raw material pieces MS discharged when using the forward rotation is larger than that when using the reverse rotation as described above. The rotation speed P1 and the rotation speed R1 are set to a standard number of revolutions.

The sheet manufacturing apparatus 100A may adopt an operation state in which the discharge pipe 132 is rotated at a rotation speed lower than the rotation speed P1 and the rotation speed R1. For example, the rotation speed P2 in FIG. 17 is lower than the rotation speed P1, and the discharge amount of raw material pieces MS is significantly smaller than the rotation speed P1. Further, the rotation speed R2 is lower than the rotation speed R1, and the discharge amount of raw material pieces MS is significantly smaller than the rotation speed R1. The rotation speed of the discharge pipe 132 may be set to the rotation speed P2 or the rotation speed R2 in addition to the rotation speeds P1 and R1. Further, since a difference in the amount of discharged raw material pieces MS at the rotation speeds P2 and R2 is small, any one of the rotation speeds P2 and R2 may be adopted in addition to the rotation speeds P1 and R1.

6-3. Configuration of Control System of Sheet Manufacturing Apparatus

Figure 18:
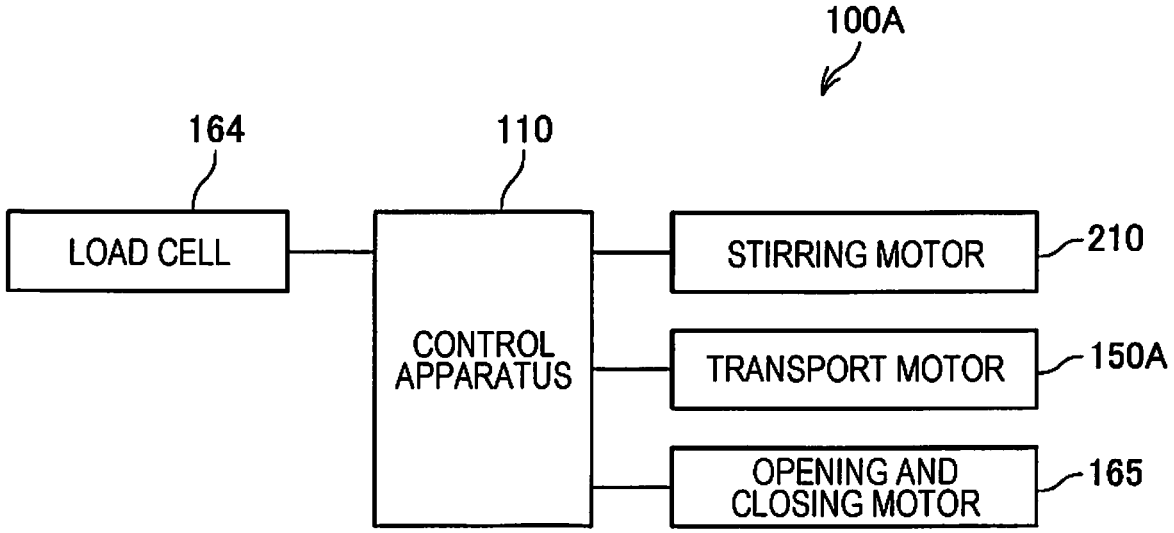
FIG. 18 is a block diagram illustrating a main configuration of a control system of a sheet manufacturing apparatus.

FIG. 18 is a block diagram illustrating a main configuration of a control system of the sheet manufacturing apparatus 100A.

The control apparatus 110 manufactures the sheet S by controlling each portion of the sheet manufacturing apparatus 100A based on an input operation of an operation portion (not illustrated) and detected values obtained by various sensors included in the sheet manufacturing apparatus 100A.

The control apparatus 110 includes, for example, a processor such as a CPU or a microcomputer, and controls each portion of the sheet manufacturing apparatus 100A by executing a program. The control apparatus 110 may be configured to include a ROM, a RAM, other signal processing circuits, and the like in addition to the processor described above, and may be configured by an SoC in which these are integrated. The control apparatus 110 execute processes by cooperating with the hardware and the software, for example, the CPU reads out the program stored in the ROM into the RAM to executes the process, or also executes a signal process in the signal processing circuit to execute the process. Further, the control apparatus 110 may be configured to include an ASIC and execute various types of processes by using functions mounted on hardware, such as a configuration in which the process is executed by using a function mounted on the ASIC.

Here, the ROM is an abbreviation of read only memory. The RAM is an abbreviation of random access memory. The CPU is an abbreviation of central processing unit. The SoC is an abbreviation of system-on-a-chip. The ASIC is an abbreviation of application specific integrated circuit.

FIG. 18 illustrates the load cell 164 among sensors coupled to the control apparatus 110. In addition, the stirring motor 210, the transport motor 150A, and the opening and closing motor 165 are illustrated as driving portions coupled to the control apparatus 110. Further, various sensors which control operations of the sheet manufacturing apparatus 100A and various driving portions which operate the sheet manufacturing apparatus 100A are coupled to the control apparatus 110, but these are not illustrated.

A signal indicating the measured value of the weight of the reception portion 160 is input from the load cell 164 to the control apparatus 110. The control apparatus 110 controls driving and stopping of the stirring motor 210. The control apparatus 110 causes the discharge pipe 132 to rotate in the forward direction and in the reverse direction by controlling driving and stopping of the transport motor 150A and switching of the rotation direction of the transport motor 150A. The control apparatus 110 controls driving and stopping of the opening and closing motor 165 and a rotation direction of the opening and closing motor 165, and operates the closing member 162 to open and close the bottom opening portion 168.

When detecting an operation of instructing a start of manufacturing of the sheet S, the control apparatus 110 initializes each portion of the sheet manufacturing apparatus 100A and starts the operation. At this time, the control apparatus 110 starts operations of the stirring motor 210 and the transport motor 150A to start stirring and transport of the raw material pieces MS. Further, when the measured value of the load cell 164 reaches a set target value, the control apparatus 110 operates the opening and closing motor 165 to open the bottom opening portion 168.

The control apparatus 110 has a timing function, and counts a time until the measured value of load cell 164 reaches the target value. The control apparatus 110 controls the rotation direction and/or the rotation speed of the transport motor 150A by comparing the counted time with a preset threshold value.

The control apparatus 110 corresponds to an example of a control portion of the present disclosure.

6-4. Operation of Sheet Manufacturing Apparatus

Figure 19:
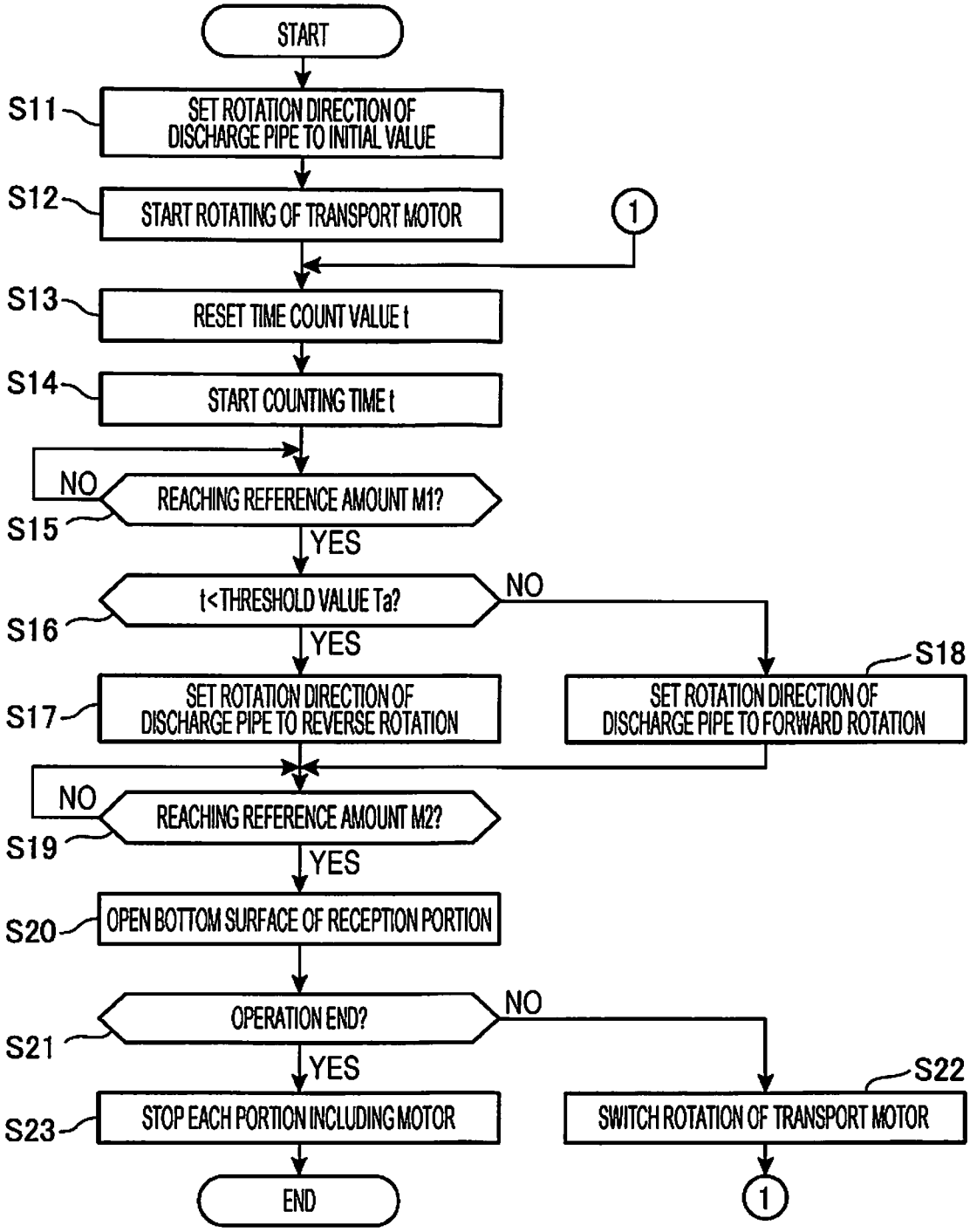
FIG. 19 is a flowchart illustrating an operation of the sheet manufacturing apparatus.

FIG. 19 is a flowchart illustrating an operation of the sheet manufacturing apparatus 100A, and particularly illustrates an operation of transporting the raw material pieces MS from the storage portion 13 to the defibration portion 20.

When the sheet manufacturing apparatus 100A starts manufacturing the sheet S, the control apparatus 110 initializes each portion of the sheet manufacturing apparatus 100A including the load cell 164 and then starts an operation in FIG. 19.

In the operation in FIG. 19, the control apparatus 110 sets the rotation direction of the discharge pipe 132, that is, the rotation direction of the transport motor 150A to an initial value (step S11), and starts rotation of the transport motor 150A (step S12). As described above, the transport motor 150A can be switched between forward rotation and reverse rotation, and the initial value is forward rotation. The forward rotation and reverse rotation of the transport motor 150A correspond to forward rotation and reverse rotation of the discharge pipe 132. When the storage portion 13 starts operating, in step S12, the discharge pipe 132 starts the forward rotation. Further, in step S12, the control apparatus 110 starts rotation of the stirring motor 210 to rotate the rotator 172. In step S12, the rotator 172 and the discharge pipe 132 start rotating, so that the raw material pieces MS are discharged from the discharge pipe 132 to the reception portion 160. Since the load cell 164 is initialized when the operation in FIG. 19 is started, the control apparatus 110 can measure the discharge amount of raw material piece MS based on the measured value of the load cell 164 in step S12 and thereafter.

The control apparatus 110 resets a time count value t (step S13). The count value t is a value obtained by counting a time when the raw material pieces MS are discharged, and specifically, indicates a time when the raw material pieces MS accumulate in the reception portion 160. The control apparatus 110 resets the time t in step S13, and starts counting the time t in step S14.

The control apparatus 110 calculates the amount of raw material pieces MS based on the measured value of load cell 164, and determines whether or not the amount of raw material pieces MS stored in the reception portion 160 reaches the reference amount M1 (step S15). When it is determined that the amount of raw material pieces MS does not reach the reference amount M1 (NO in step S15), the control apparatus 110 stands by. When it is determined that the amount of raw material pieces MS reaches the reference amount M1 (YES in step S15), the control apparatus 110 determines whether or not the time t is smaller than the preset threshold value Ta (step S16). In step S16, the control apparatus 110 determines whether or not the amount of raw material pieces MS reaches the reference amount M1 in a shorter time than the threshold value Ta.

When the time t is smaller than the threshold value Ta (YES in step S16), the control apparatus 110 sets the rotation direction of the discharge pipe 132 to the reverse direction RV (step S17). In addition, when the time t is equal to or larger than the threshold value Ta (NO in step S16), the control apparatus 110 sets the rotation direction of the discharge pipe 132 to the forward direction RO (step S18).

The control apparatus 110 determines the rotation direction of the discharge pipe 132 in steps S17 and S18, but does not perform control to actually switch the rotation direction until step S22 to be described below.

After performing the processes in step S17 or step S18, the control apparatus 110 calculates the amount of raw material pieces MS based on the measured value of the load cell 164, and determines whether or not the amount of raw material pieces MS stored in the reception portion 160 reaches the reference amount M2 (step S19). When it is determined that the amount of raw material pieces MS does not reach the reference amount M2 (NO in step S19), control apparatus 110 stands by. When it is determined that the amount of raw material pieces MS reaches the reference amount M2 (YES in step S19), the control apparatus 110 operates the opening and closing motor 165 to open the bottom opening portion 168 (step S20). Thus, the raw material pieces MS stored in the reception portion 160 are sent toward the defibration portion 20, and the reception portion 160 becomes empty.

The control apparatus 110 determines whether or not to terminate the operation of manufacturing the sheet S (step S21). When the operation is not completed (NO in step S21), the control apparatus 110 changes the rotation direction of the transport motor 150A based on the rotation direction set in step S17 or step S18 (step S22), and returns to step S13. In step S22, when the rotation directions before and after the switching are the same, the control apparatus 110 returns to step S13 without changing the rotation direction.

When the production of the sheet S is completed (YES in step S21), the control apparatus 110 stops each portion of the sheet manufacturing apparatus 100A including the stirring motor 210 and the transport motor 150A (step S23).

As described above, the sheet manufacturing apparatus 100A of the present embodiment includes the case 170 which accommodates the raw material pieces MS including fibers, and the transport apparatus 131 which transports the raw material pieces MS through the transport path 133 coupled to the side wall 180 of the case 170. The sheet manufacturing apparatus 100A includes the control apparatus 110 which controls the transport apparatus 131. The transport apparatus 131 includes the discharge pipe 132 which rotates on the central axis L1 along the transport path 133, and the transport motor 150A which rotates the discharge pipe 132. The control apparatus 110 can switch the rotation direction of the discharge pipe 132 between the forward direction and the reverse direction.

With this configuration, when the raw material pieces MS accommodated in the case 170 are transported through the transport path 133, the transport amount of raw material pieces MS can be adjusted by changing the rotation direction of the discharge pipe 132. For this reason, it is possible to stably supply the raw material pieces MS which are raw materials for manufacturing the sheet S from the storage portion 13 to the defibration portion 20, and it is possible to stabilize the amount of raw material pieces MS supplied to the defibration portion 20.

The sheet manufacturing apparatus 100A includes the discharge pipe 132 corresponding to an example of a tube as a rotator forming the transport path 133, and causes the transport motor 150A to rotate the discharge pipe 132. Therefore, it is possible to easily realize a configuration in which the rotation direction of the rotator can be switched between the forward direction and the reverse direction. Further, by adopting the tube-shaped discharge pipe 132 as the rotator, it is not necessary to use a member having a shaft penetrating the inside of the discharge pipe 132. Therefore, the raw material pieces MS can be stirred and transported inside the discharge pipe 132 without using a member which hinders the transport of the raw material pieces MS. When the raw material pieces MS are stirred, an action of unraveling the lump-shaped raw material pieces MS can be expected, and a change in the transport amount occurring when the raw material pieces MS are transported as the lump can be suppressed. In addition, by eliminating the lump of the raw material pieces MS, the transport amount of raw material pieces MS is easily changed by changing the rotation direction of the discharge pipe 132, so that the transport amount of raw material pieces MS can be more easily adjusted. Therefore, it is possible to stabilize the transport amount when transporting the raw material pieces MS obtained by cutting the raw material MA in a sheet shape such as paper by using the crushing portion 12.

In the discharge pipe 132, one end in the central axis L1 communicates with the internal space 170A of the case 170 and the other end has the open outlet 1328 for discharging the raw material pieces MS, and the spiral member 140 is disposed at the inner peripheral surface 132C of the discharge pipe 132. With this configuration, the raw material pieces MS can be discharged from the internal space 170A to the outlet 132B through the discharge pipe 132. By disposing the spiral member 140 inside the discharge pipe 132, the raw material pieces MS can be quickly transported to the outlet 132B by the rotation of the discharge pipe 132. In addition, since the raw material pieces MS are stirred by the spiral member 140 inside the discharge pipe 132, the lump-shaped raw material pieces MS can unravel more effectively. Therefore, the raw material pieces MS can be efficiently stirred and transported without disposing a member having an axis along the central axis L1 inside the discharge pipe 132. Further, for example, when the disposition state and/or shape of the spiral member 140 is in a mode in which a difference in the transport action occurs according to the rotation direction of the discharge pipe 132, by changing the rotation direction of the discharge pipe 132, it is possible to easily adjust the transport amount of the raw material pieces MS.

The spiral member 140 is spirally disposed on the central axis L1 of the discharge pipe 132. Therefore, by rotating the discharge pipe 132, the raw material pieces MS can be quickly discharged inside the discharge pipe 132. There is a large difference in the action of the spiral member 140 for transporting the raw material pieces MS between when the rotation direction of the discharge pipe 132 is the forward direction and when the rotation direction is the reverse direction. Therefore, by changing the rotation direction of the discharge pipe 132, the transport amount of raw material pieces MS can be reliably changed, and the effect of adjusting the transport amount of raw material pieces MS by the control apparatus 110 increases.

The discharge pipe 132 is inclined so that the outlet 132B side is lower than the discharge portion 186 which is a coupling portion with the case 170. Therefore, by rotating the discharge pipe 132, the raw material pieces MS can be efficiently transported by gravity.

In the sheet manufacturing apparatus 100A, the reception portion 160 which accommodates the raw material pieces MS is disposed below the outlet 132B. With this configuration, the control apparatus 110 operates the transport motor 150A to transport the raw material pieces MS from the discharge pipe 132 to the reception portion 160 and accommodate the raw material pieces MS in the reception portion 160. With the control of the control apparatus 110, the amount of raw material pieces MS accommodated in the reception portion 160 can be adjusted.

In the sheet manufacturing apparatus 100A, the load cell 164 which measures the weight of the raw material pieces MS accommodated in the reception portion 160 is disposed. With this configuration, it is possible to measure the weight of the raw material pieces MS accommodated in the reception portion 160, and the control apparatus 110 can execute control based on the measured weight of the raw material pieces MS. For example, the control apparatus 110 controls the switching of the rotation direction of the discharge pipe 132 based on the weight of the raw material pieces MS transported from the discharge pipe 132 to the reception portion 160, and adjusts the transport amount or the transport speed of the raw material pieces MS to stabilize the transport of the raw material pieces MS.

The sheet manufacturing apparatus 100A includes the rotator 172 which rotates on the virtual rotation axis extending in the height direction of the case 170 and stirs the raw material pieces MS inside the case 170. The discharge pipe 132 is coupled to the case 170 at an overlapping position with the rotator 172 in the height direction of the case 170. With this configuration, it is possible to unravel the lump-shaped raw material pieces MS by stirring raw material pieces MS by the rotator 172 in the case 170. In addition, since the rotator 172 stirs the raw material pieces MS, an action of pushing the raw material pieces MS from the case 170 to the discharge pipe 132 can be expected. For this reason, the raw material pieces MS can be transported more efficiently by the discharge pipe 132.

7. Embodiment 7

Figure 20:
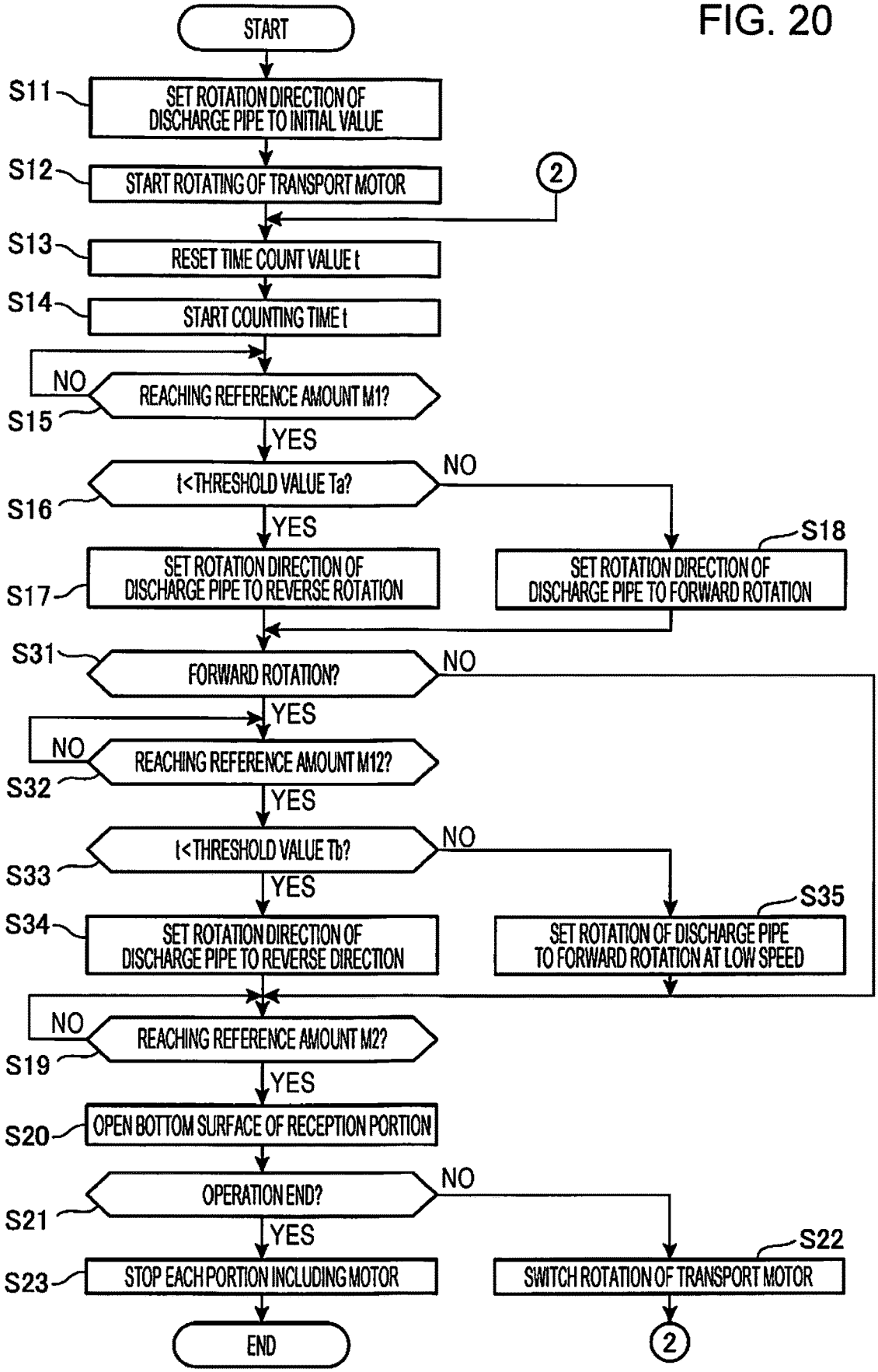
FIG. 20 is a flowchart illustrating an operation of a sheet manufacturing apparatus according to Embodiment 7.

FIG. 20 is a flowchart illustrating an operation of the sheet manufacturing apparatus 100A according to Embodiment 7, and particularly illustrates an operation of transporting the raw material pieces MS from the storage portion 13 to the defibration portion 20. In the flowchart in FIG. 20, the same processes as those in FIG. 19 are denoted by the same step numbers, and description thereof will not be repeated.

Embodiment 7 illustrates another operation example of the control apparatus 110. The sheet manufacturing apparatus 100A of Embodiment 7 is common to that of Embodiment 6, and differs in steps S31 to S35 in FIG. 20. The control apparatus 110 can switch the rotation direction of the discharge pipe 132 between the forward direction RO and the reverse direction RV, and can switch the rotation speed of the discharge pipe 132 between a plurality of stages. More specifically, the control apparatus 110 can switch the rotation speed of the forward rotation of the discharge pipe 132 between two stages of a standard speed and a low speed. The standard rotation speed is, for example, the rotation speed P1 in FIG. 17, and the low rotation speed is, for example, the rotation speed P2 in FIG. 17.

In the operation example in FIG. 20, after setting the rotation direction in step S17 or step S18, the control apparatus 110 determines whether or not the current rotation direction of the discharge pipe 132 is the forward direction RO (step S31). When it is determined that the current rotation direction is the forward direction RO (YES in step S31), the control apparatus 110 obtains the amount of raw material pieces MS based on the measured value of the load cell 164, and determines whether or not the amount of raw material pieces MS reaches a reference amount M12 (step S32). The reference amount M12 is a value set separately from the reference amount M1 and the reference amount M2 so as to determine a state of an increase of the discharge amount of raw material pieces MS, and the reference amount M1<the reference amount M12<the reference amount M2.

When it is determined that the amount of raw material pieces MS does not reach the reference amount M12 (NO in step S32), the control apparatus 110 stands by. When it is determined that the amount of raw material pieces MS reaches the reference amount M12 (YES in step S32), the control apparatus 110 determines whether or not the time t is smaller than a preset threshold value Tb (step S33). In other words, the control apparatus 110 determines whether or not the amount of raw material pieces MS reaches the reference amount M12 in a shorter time than threshold value Tb. The threshold value Tb is a time threshold value set separately from the threshold value Ta for determining the state of the increase of the discharge amount of raw material pieces MS, and the threshold value Ta<the threshold value Tb.

When the time t is smaller than the threshold value Tb (YES in step S33), the control apparatus 110 changes the current rotation direction of the discharge pipe 132 to the reverse direction RV (step S34), and proceeds to step S19. On the other hand, when the time t is equal to or larger than the threshold value Tb (NO in step S33), the control apparatus 110 changes the current rotation speed of the discharge pipe 132 to the rotation speed P2 (step S34), and proceeds to step S19. When it is determined that the current rotation direction of the discharge pipe 132 is the reverse direction RV (NO in step S31), the process proceeds to step S19.

The operation after step S19 is as described in Embodiment 6. In step S22, the rotation direction set in step S17 or step S18 is set as the rotation direction of the discharge pipe 132. Further, in step S22, the rotation speed of the discharge pipe 132 is set to the rotation speed P1 or the rotation speed R1 which is a standard speed.

In Embodiment 7, after the amount of raw material pieces MS stored in the reception portion 160 reaches the reference amount M12, the rotation direction of the discharge pipe 132 is set to the reverse direction RV, or the rotation speed of the discharge pipe 132 is switched into the rotation speed P2. That is, after the amount of raw material pieces MS reaches the reference amount M12, the discharge pipe 132 is not rotated at the rotation speed P1. Therefore, after the amount of raw material pieces MS reaches the reference amount M12, the transport speed of the raw material pieces MS becomes lower than that at the rotation speed P1, and the raw material pieces MS are slowly sent to the reception portion 160.

According to this operation example, the transport speed of the raw material pieces MS does not increase from a time when the amount of raw material pieces MS reaches the reference amount M12 to a time when the amount of raw material pieces MS reaches the reference amount M2, and so-called overshooting in which the amount of the raw material pieces MS exceeds the reference amount M2 can be avoided. For this reason, a state in which an excessive amount of raw material pieces MS are stored in the reception portion 160 can be avoided or suppressed, and the transport of the raw material pieces MS to the defibration portion 20 can be further stabilized. Further, when the discharge pipe 132 rotates in the forward direction, the discharge pipe 132 operates at the rotation speed P1 until the amount of the raw material pieces MS reaches the reference amount M12, there is an advantage that the transport speed of the raw material pieces MS is not excessively reduced and there is no concern on a decrease in transport efficiency.

8. Embodiment 8

Figure 21:
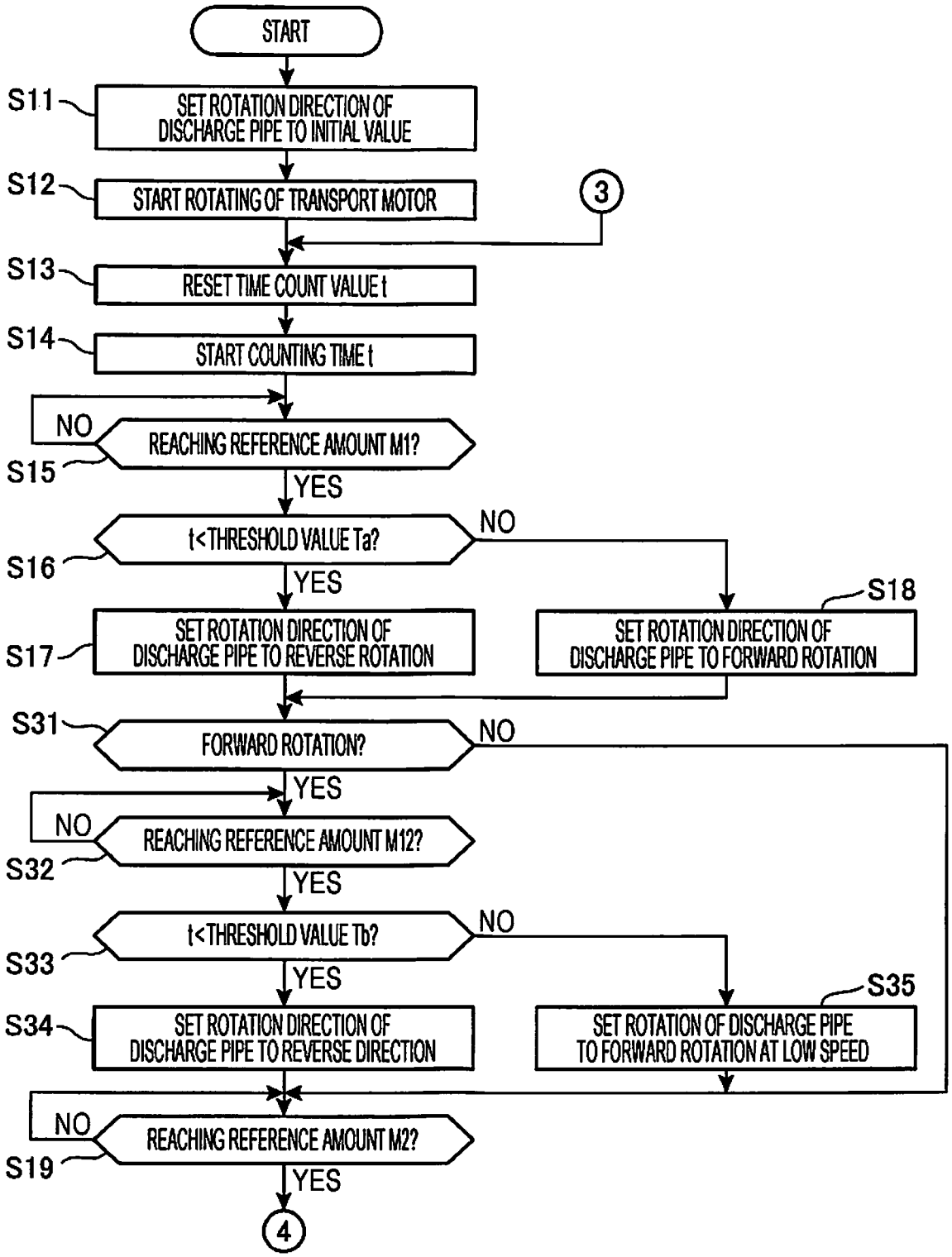
FIG. 21 is a flowchart illustrating an operation of a sheet manufacturing apparatus according to Embodiment 8.
Figure 22:
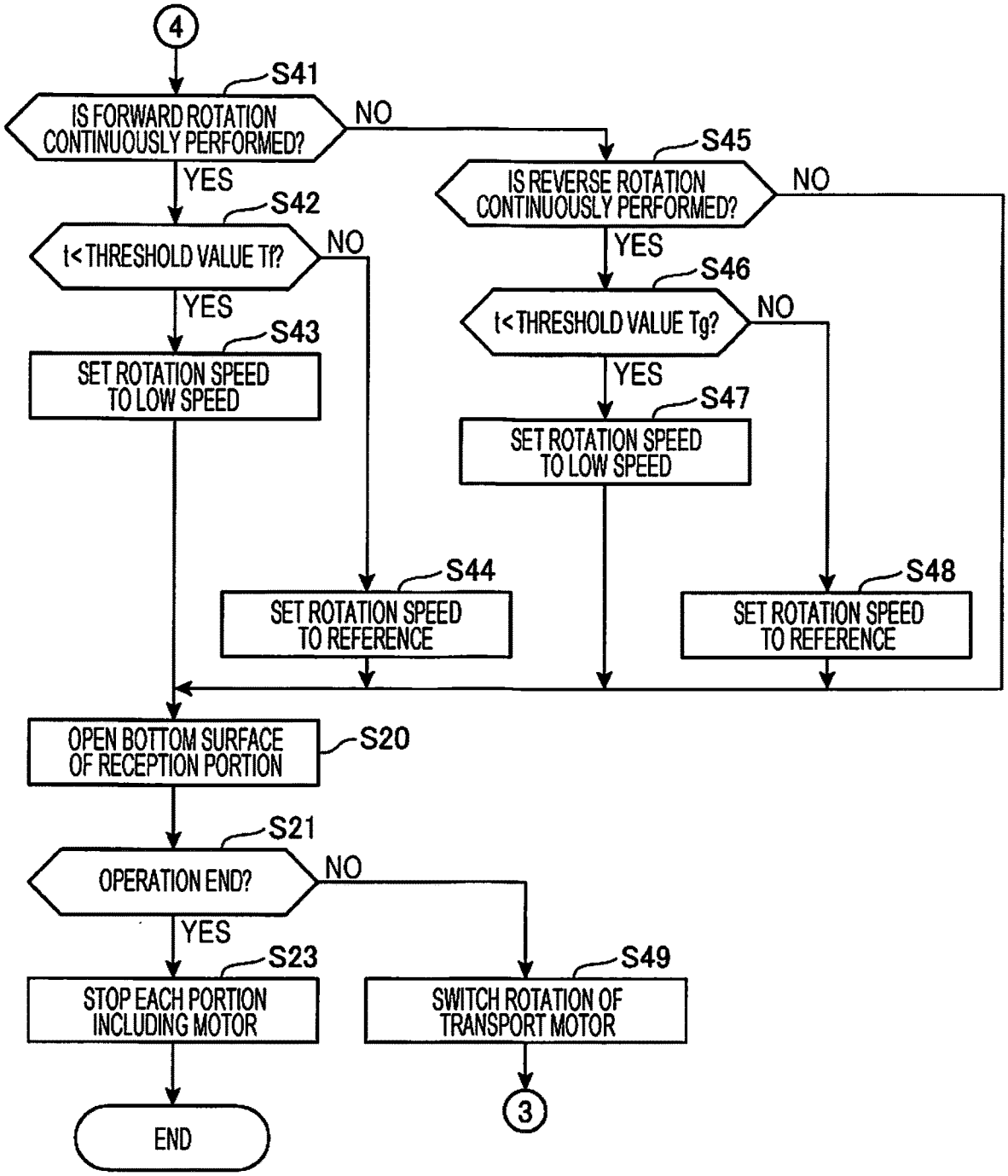
FIG. 22 is a flowchart illustrating another operation of the sheet manufacturing apparatus according to Embodiment 8.

FIGS. 21 and 22 are flowcharts illustrating an operation of the sheet manufacturing apparatus 100A according to Embodiment 8, and particularly illustrates an operation of transporting the raw material pieces MS from the storage portion 13 to the defibration portion 20. In the flowchart in FIGS. 21 and 22, the same processes as those in FIG. 20 are denoted by the same step numbers, and description thereof will not be repeated.

Embodiment 8 illustrates another operation example of the control apparatus 110. The sheet manufacturing apparatus 100A according to Embodiment 8 is common to that of Embodiment 7, and differs in steps S41 to S49 in FIG. 22.

In Embodiment 8, the control apparatus 110 can switch the rotation direction of the discharge pipe 132 between the forward direction RO and the reverse direction RV, and can further control to switch the rotation speed of the discharge pipe 132 between a plurality of stages for each of the forward direction RO and the reverse direction RV. More specifically, the control apparatus 110 can switch the rotation speed of the discharge pipe 132 in the forward rotation between two stages of the standard and low speed, and can switch the rotation speed in the reverse rotation between two stages of standard and low speed. The standard rotation speeds are, for example, the rotation speeds P1 and R1 in FIG. 17, and the low rotation speeds are, for example, the rotation speeds P2 and R2 in FIG. 17.

In the operation examples in FIGS. 21 and 22, the operations of steps S11 to S19 are as described above.

When it is determined that the amount of raw material pieces MS reaches the reference amount M2 in step S19 (YES in step S19), the control apparatus 110 determines whether or not to continuously perform the forward rotation operation (step S41). In step S41, the control apparatus 110 obtains the rotation direction set in step S17 or step S18 and the currently set rotation direction. The control apparatus 110 determines whether or not continue the operation of executing steps S13 to S19 in the forward rotation.

When the operation of the forward rotation is continuously executed (YES in step S41), the control apparatus 110 determines whether or not a value of the time t when the amount of the raw material pieces MS reaches the reference amount M2 in step S19 is smaller than a preset threshold value Tf (step S42). The threshold value Tf is a time threshold value set separately from the threshold values Ta and Tb for determining the state of the increase of the discharge amount of raw material pieces MS.

When the value of the time t is smaller than the threshold value Tf (YES in step S42), the control apparatus 110 sets the rotation speed of the discharge pipe 132 to the low speed (step S43), and proceeds to step S20. When the value of the time t is equal to or larger than the threshold value Tf (NO in step S42), the control apparatus 110 sets the rotation speed of the discharge pipe 132 to the standard speed (step S44), and proceeds to step S20.

When it is determined that the forward rotation operation is not to be continuously performed (NO in step S41), the control apparatus 110 determines whether or not to continuously execute the reverse rotation operation (step S45). In step S45, the control apparatus 110 determines whether or not to continue the operation of executing steps S13-S19 in the reverse rotation based on the rotation direction set in step S17 or step S18 and the currently set rotation direction.

When the operation of the reverse rotation is continuously executed (YES in step S45), the control apparatus 110 determines whether or not the value of the time t when the amount of the raw material pieces MS reaches the reference amount M2 in step S19 is smaller than a preset threshold value Tg (step S46). The threshold value Tg is a time threshold value set separately from the threshold values Ta, Tb, and Tf for determining the state of the increase of the discharge amount of raw material pieces MS.

When the value of the time t is smaller than the threshold value Tg (YES in step S46), the control apparatus 110 sets the rotation speed of the discharge pipe 132 to the low speed (step S47), and proceeds to step S20. In addition, when the value of the time t is equal to or larger than the threshold value Tg (NO in step S46), the control apparatus 110 sets the rotation speed of the discharge pipe 132 to the standard speed (step S48), and proceeds to step S20.

When the control apparatus 110 determines that the reverse rotation operation is not continuously performed (NO in step S45), the control apparatus 110 proceeds to step S20.

In the operation example in FIG. 22, the operation of step S49 is executed instead of step S22. In step S49, the control apparatus 110 changes the rotation direction of the transport motor 150A based on the rotation direction set in step S17 or step S18, and further changes the rotation speed to the speed set in any one of steps S43, S44, S47, and S48. When it is determined that the reverse rotation operation is not continuously performed in step S45 (NO in step S45), in step S49, the rotation speed is set to the standard speed.

In Embodiment 8, when the control apparatus 110 continuously executes the operation of the forward rotation, and when the amount of raw material pieces MS reaches the reference amount M2 in a shorter time than the threshold value Tf, the rotation speed is set to the low speed. In addition, when the control apparatus 110 continuously executes the reverse rotation operation, and when the amount of raw material pieces MS reaches the reference amount M2 in a shorter time than the threshold value Tg, the rotation speed is set to the low speed. In this case, when the amount of the raw material pieces MS reaches the reference amount M2 in a short time based on the value of the time t which is an actual value when the operation of storing the raw material pieces MS in the reception portion 160 is executed, the next time the receiving is performed, it is possible to reduce a speed at which the raw material pieces MS are supplied to the reception portion 160 next time. Here, the next operation refers to an operation of storing the raw material pieces MS in the reception portion 160 after opening the bottom opening portion 168.

In the operation illustrated in FIG. 21, in step S16, it is determined whether the next operation is the forward rotation or the reverse rotation based on the threshold value Ta. In steps S41 to S48 in FIG. 22, by using the threshold values Tf and Tg, it is possible to more finely determine the transport state of the raw material pieces MS, and it is possible to determine the rotation speed of the discharge pipe 132. Thus, it is possible to prevent overshooting in the amount of raw material pieces MS which may occur when the transport speed is high. Further, in a state in which there is no concern on overshooting, by maintaining the rotation speed at the standard speed, it is possible to prevent a decrease in the transport efficiency of the raw material pieces MS. Therefore, the raw material pieces MS can be efficiently and promptly transported, and the effect of stabilizing the transport amount can be obtained.

9. Other Embodiments

Each of the above-described embodiments is merely a specific mode for implementing the present disclosure described in the claims, does not limit the present disclosure, and can be implemented in various aspects without departing from the gist thereof.

In the above-described embodiment, the configuration in which as the rotator 172, the disk-shaped rotating portion 190 rotates is described. Meanwhile, as described in JP-A-2011-241497, a rotator may be configured by a rotating shaft and a rod member supported by the rotating shaft, and the rotator may be rotated inside the case 170.

In the above embodiment, the spiral member 140 corresponding to an example of the protrusion is formed integrally and continuously in the axial direction, but a configuration in which a plurality of spiral members separated in the axial direction may be provided. Further, the protrusion needs not be a plate material which is spirally curved.

For example, in Embodiment 6 to Embodiment 8, the control apparatus 110 may stop the stirring motor 210 and stop the rotation of the rotating portion 190 during the operation of rotating the discharge pipe 132 in the reverse direction RV.

In Embodiment 6 to Embodiment 8 described above, after the rotation of the stirring motor 210 and the transport motor 150A is started in step S12, the operation of each motor is continued until step S23. In this case, when the rotation direction of the transport motor 150A is switched to the reverse direction RV in step S22 or step S49, the control apparatus 110 may stop the stirring motor 210.

Further, when the rotation direction of the transport motor 150A is switched from the reverse direction RV to the forward direction RO in step S22 or step S49, the control apparatus 110 may start the operation of the stirring motor 210. When the stirring motor 210 is stopped, the action of sending out the raw material pieces MS from the case 170 to the discharge pipe 132 is reduced. For this reason, the amount of raw material pieces MS discharged from the discharge pipe 132 per unit time is further reduced. That is, the difference in the transport amount of raw material pieces MS between when the discharge pipe 132 is rotated in the forward direction and when the discharge pipe 132 is rotated in the reverse direction is increased. Therefore, the control apparatus 110 can more significantly adjust the transport amount of raw material pieces MS.

What is claimed is:

1. A fiber transport apparatus comprising:

a case that has an internal space configured to accommodate fiber pieces containing fibers;

a tube coupled to a side surface of the case; and a driving portion that rotates the tube on a virtual axis, one end of the tube in an axial direction communicating with the internal space, and another end having an outlet for discharging the fiber pieces, a protrusion being provided on an inner surface of the tube, the tube including an annular rib that is formed at the outlet, the annular rib extending, in a perpendicular direction perpendicular to the axial direction of the tube, from the inner surface of the tube toward the virtual axis of the tube, and an outlet side-inner surface on an outlet side of the tube being a low friction portion having a friction coefficient lower than a friction coefficient of a coupling portion side-inner surface of the tube on a coupling portion side with the case, the low friction portion being formed by a film member that is attached to the inner surface on the outlet side of the tube and has a friction coefficient lower than the friction coefficient of the coupling portion side-inner surface of the tube.

2. The fiber transport apparatus according to claim 1, wherein the protrusion is in a spiral shape and provided on the tube with respect to the virtual axis.

3. The fiber transport apparatus according to claim 2, wherein the protrusion has a first protrusion in a spiral shape and a second protrusion in a spiral shape, and the first protrusion and the second protrusion are provided in a part, including the outlet, of the tube.

4. The fiber transport apparatus according to claim 3, wherein the second protrusion has a pitch identical with a pitch of the first protrusion, and the second protrusion is displaced from the first protrusion by a half cycle in a rotation direction of the tube.

5. The fiber transport apparatus according to claim 1, wherein the tube is inclined such that the outlet is lower in a vertically downward direction than a coupling portion with the case.

6. The fiber transport apparatus according to claim 1, wherein a container that accommodates the fiber pieces is disposed below the outlet.

7. The fiber transport apparatus according to claim 6, wherein a weight measurement portion that measures a weight of the fiber pieces accommodated in the container is disposed.

8. The fiber transport apparatus according to claim 1, wherein a rotator that rotates on a virtual rotation axis extending in a height direction of the case and stirs the fiber pieces is provided inside the case, and the tube is coupled to the case at an overlapping position with the rotator in the height direction of the case.

9. The fiber transport apparatus according to claim 1, further comprising a control portion that controls the driving portion, wherein the driving portion rotates a rotator that rotates on an axis along a transport path, and the control portion is configured to switch a rotation direction of the rotator between a forward direction and a reverse direction.

10. The fiber transport apparatus according to claim 9, wherein the rotator is the tube that forms the transport path, and the driving portion rotates the tube.

11. The fiber transport apparatus according to claim 9, wherein the protrusion is in a spiral shape and disposed on the tube with respect to the virtual axis.

12. The fiber transport apparatus according to claim 9, wherein the tube is inclined such that the outlet is lower than a coupling portion with the case.

13. The fiber transport apparatus according to claim 9, wherein a container that accommodates the fiber pieces is disposed below the outlet.

14. The fiber transport apparatus according to claim 13, wherein a weight measurement portion that measures a weight of the fiber pieces accommodated in the container is disposed.

15. The fiber transport apparatus according to claim 9, wherein a second rotator that rotates on a virtual rotation axis extending in a height direction of the case and stirs the fiber pieces is provided inside the case, and the tube is coupled to the case at an overlapping position with the second rotator in the height direction of the case.

* * * * *